US006240614B1

(12) United States Patent
Kojima et al.

(10) Patent No.: US 6,240,614 B1
(45) Date of Patent: Jun. 5, 2001

(54) BLIND RIVET DISASSEMBLING DEVICE AND METHOD AND PRODUCTION SYSTEM USING THE METHOD

(75) Inventors: Takao Kojima; Yuichi Jibiki, both of Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/444,385

(22) Filed: Nov. 22, 1999

(30) Foreign Application Priority Data

Nov. 20, 1998 (JP) ..... 10-330829
Oct. 7, 1999 (JP) ..... 11-286758

(51) Int. Cl.[7] ..... B23P 19/04
(52) U.S. Cl. ..... 29/426.4; 29/268; 29/566.1
(58) Field of Search ..... 29/566.1, 246, 29/267, 268, 261, 243.53, 232, 426.8, 426.4; 30/92, 208; 81/309, 13

(56) References Cited

U.S. PATENT DOCUMENTS 358,016 * 2/1887 Clark ..... 29/246
507,817 * 10/1893 Ingalls ..... 81/309 X
510,897 * 12/1893 Crook ..... 29/232
1,498,488 * 6/1924 Stallings ..... 81/309
1,962,814 * 6/1934 Gilstrap et al. ..... 29/246
2,037,834 * 4/1936 Sutherland ..... 29/246
2,375,081 * 5/1945 Colley ..... 29/246
2,470,327 * 5/1949 Tener ..... 29/232
2,484,043 * 10/1949 Malen ..... 29/267
2,486,851 * 11/1949 Jennings ..... 9/246
4,010,532 * 3/1977 Streeter ..... 29/267
4,360,136 * 11/1982 Bates ..... 83/697 X
5,168,616 * 12/1992 Klein ..... 29/268
5,177,848 * 1/1993 Halstead ..... 29/246
6,006,410 * 12/1999 Hudspeth ..... 29/251

FOREIGN PATENT DOCUMENTS 56-3131 * 1/1981 (JP) ..... 30/92
56-114617 * 9/1981 (JP) ..... 30/208
3-31467 7/1991 (JP) .

* cited by examiner

*Primary Examiner*—William Briggs
(74) *Attorney, Agent, or Firm*—Oblon, Spivak, McClelland, Maier & Neustadt, P.C.

(57) ABSTRACT

A blind rivet disassembling device comprising a cutting means adapted to get in between a flange portion of a blind rivet and a base metal and cut a body portion of the blind rivet in a direction perpendicular to the axial direction of the body portion and toward a center of a through hole formed through the blind rivet, a push-out means which pushes out a residual mandrel from the flange portion toward a bulge of the through hole along the axial direction of the body portion, a moving means which causes the cutting means to move toward the center of the through hole, and an advancing means which causes the push-out means to advance into the through hole for pushing out the residual mandrel interlocked with the movement of the cutting means.

23 Claims, 16 Drawing Sheets

BLIND RIVET DISASSEMBLING DEVICE AND METHOD AND PRODUCTION SYSTEM USING THE METHOD

BACKGROUND OF THE INVENTION

1. Field of the Invention

The present invention relates to a blind rivet disassembling device and method and a production system using the method, wherein a blind rivet body having a body portion and a flange portion, with a through hole being formed through the blind rivet body in an axial direction of the body portion from the body portion toward the flange portion, is inserted into clamping holes formed in base metals, a mandrel having a stem portion and a head portion, the head portion being substantially integral with the stem portion and larger than the diameter of the through hole of the blind rivet body, is inserted into the through hole, the head portion of the mandrel is pulled into the through hole as the mandrel is pulled, so that a peripheral wall of the body portion around the through hole undergoes a plastic deformation and is bulged and the mandrel is broken, allowing a portion of the mandrel to remain as a residual mandrel within the through hole, the base metals are sandwiched by the bulge of the peripheral wall of the body portion and the head portion of the mandrel, and the blind rivet clamped to the base metals is separated from the base metals.

2. Description of the Related Art

As a technique for joining base metals such as steel plates or plastic plates or for joining another member to such a base metal there is known a rivet clamping technique. As an example there is known a clamping method in which base metals 1 and 2 are joined mechanically with use of a blind rivet.

As shown in FIG. 14(*a*), the blind rivet, indicated at 10, comprises a blind rivet body 11 and a mandrel (core stem) 12. The blind rivet body 11 comprises a body portion 11*b* and a flange portion 11*c* which is substantially integral with the body portion 11*b*. A through hole 11*a* is formed through the blind rivet body 11 in an axial direction of the body portion 11*b* from the body portion toward the flange portion 11*c*. The mandrel 12 comprises a head portion 12*a* and a stem portion 12*c* which is substantially integral with the head portion. The head portion 12*a* has an outside diameter larger than the diameter of the through hole 11*a*. The stem portion 12*c* is formed with a constriction 12*b* at an intermediate position in its extending direction.

Using the blind rivet 10, the base metals 1 and 2 are clamped together mechanically in accordance with the following procedure for example.

First, the body portion 11*b* of the blind rivet body 11 is inserted into clamping holes 1*a* and 2*a* of base metals 1 and 2, as shown in FIG. 15(*a*), and a blind rivet clamping device 13 is set at an end portion of the mandrel 12, as shown in FIG. 15(*b*), Then, as shown in FIG. 15(*c*), a nose piece 13*a* of the blind rivet clamping device 13 is brought into close contact with the flange portion 11*c* of the blind rivet body 11 and the blind rivet clamping device 13 is triggered while the flange portion 11*c* is pushed against the base metal 1 by the nose piece 13*a*.

As a result, the mandrel 12 is chucked by a jaw member 13*b* of the blind rivet clamping device 13 and is pulled in the direction opposite to the pushing direction, then as the head portion 12*a* of the mandrel is pulled into the through hole 11*a*, the peripheral wall of the body portion 11*b* projecting from the back side of the base metal 2 is deformed plastically into a bulge 11*d* by the head portion 12*a* of the mandrel 12, which is brought into pressure contact with the base metal 2.

In this state, if the jaw member 13*b* is further pulled in the direction opposite to the pushing direction, the mandrel 12 will be broken at its constriction 12*b*, so that the base metals 1 and 2 are clamped together by the blind rivet 10, as shown in FIG. 15(*d*). A portion of the mandrel 12 remains as a residual mandrel 12' within the through hole 11*a*, as shown in FIG. 14(*b*).

According to this method using the blind rivet 10, since the base metal clamping is effected by applying tension in the direction opposite to the pushing direction, as shown in FIGS. 15(*a*) to 15(*d*), the clamping work for the base metals 1 and 2 can be done without supporting the back side of the base metals and therefore this method is suitable for clamping the base metals 1 and 2 in such a place where the worker's hand cannot reach the back side of the base metals.

Thus, in the blind rivet 10, as the mandrel 12 inserted into the through hole 11*a* of the blind rivet body 11 is pulled, the peripheral wall of the body portion undergoes a plastic deformation, with consequent formation of the bulge 11*d*, and the base metals 1 and 2 are held in a clamped state by both bulge 11*d* and flange portion 11*c*. In the event there should occur a defective clamp in clamping the blind rivet 10 to the base metals 1 and 2 and the resulting necessity of repeating the same work or in the event there should occur the necessity of recycling the base metals 1 and 2, it is necessary to disassemble and remove the blind rivet 10.

As a disassembling method for the blind rivet 10 there is known such a method as shown in FIG. 16, in which with a drill 14, the flange portion 11*c* of the blind rivet 10 is cut and removed from the body portion 11*b*, then, by tapping the cut portion in a direction in which the body portion 11*b* comes out of the clamping holes 1*a* and 2*a*, the blind rivet 10 is pulled out from the base metals 1 and 2.

Such a conventional blind rivet disassembling method requires much time and labor for preparatory works, including selection of the drill 14 and the cutting work. Moreover, in cutting the flange portion 11*c*, if the tip of the drill 14 reaches the base metal 1 and cuts the clamping hole 1*a* of the base metal, with consequent increase in size of the clamping hole 1*a*, as shown in FIG. 17, it will be impossible to ensure a sufficient clamping force even if this base metal 1 is recycled and re-clamped using the blind rivet 10. Generally, once the base metals 1 and 2 are flawed in the blind rivet disassembling work, it becomes difficult to recycle such base metals.

Further, in the case of using this type of a drill in the clamp member disassembling work, the blind rivet body 11 undergoes a follow-up rotation with rotation of the drill 14 at the time of cutting the flange portion 11*c* of the blind rivet 10, thus giving rise to the problem that the base metal 1 is scratched or it is impossible to cut the flange portion 11*c*. Particularly, when the base metal 1 is used as an outer component of a product, a scratch, if any, on the surface of the base metal 1 will markedly deteriorate the commercial value of the product. Therefore, such a scratched base metal 1 cannot be recycled, and if it should be recycled, the percent defective of the base metal at the time of disassembly would become very high.

Therefore, to prevent the follow-up rotation of the clamp member with rotation of the drill 14, the flange portion 11*c* is cut with by the drill 14, as shown in FIG. 16, while the flange portion 11*c* or the body portion 11*b* is chucked by a chucking tool 15 such as pliers or pincers. However, this work is performed by two or more workers because it is dangerous if this work is done by one worker, resulting in an increase of personnel expenses in the disassembling work.

Particualarly, as shown in FIG. 18, when the flange portion 11*c* of the blind rivet 10 is in a flat shape and is difficult to be chucked by the chucking tool 15 and when the base metals 1 and 2 are clamped by the blind rivet 10 in such a place where the worker's hand cannot reach the back side of the base metals, it is difficult to prevent the follow-up rotation because the body portion 11*b* cannot be chucked by the chucking tool 15.

As another method for removing the blind rivet 10 from the base metals 1 and 2 there also is known a method in which the flange portion 11*c* of the blind rivet 10 and the body portion 11*b* are cut from each other while nipping the flange portion 11*c* by a cutting tool such as a nipper. According to this method, the follow-up rotation of the blind rivet 10 can be prevented at the time of cutting the flange portion 11*c* and the body portion 11*b* from each other, so that the inconveniences encountered in the disassembling method using the drill 14 can be eliminated.

However, in the blind rivet 10, as shown in FIG. 14(*b*), its body portion 11*b* is deformed plastically by the head portion 12*a* of the mandrel 12 and is caulked to the base metals 1 and 2, the mandrel 12 is formed using a material of a higher hardness than the hardness of the body portion 11*b* in order to cause a plastic deformation of the mandrel 12, and in a clamped state of the blind rivet 10 to the base metals 1 and 2 a portion of the mandrel 12 remains as the residual mandrel 12' within the through hole 11*a*.

Therefore, in the method wherein the body portion 11*b* of the blind rivet 10 is nipped by such a cutting tool as a nipper and in this state the flange portion 11*c* and the body potion 11*b* are separated from each other, a cutting edge of the cutting tool may come into abutment against the residual mandrel 12' remaining in the through hole 11*a* of the blind rivet body 11 at the time of cutting the body portion 11*b* and this abutment may inhibit the cutting work by the cutting tool.

In this case, if an attempt is made to cut the residual mandrel 12' forcibly, a large cutting force is required for cutting the flange portion 11*c* and there is a fear that the cutting edge of the cutting tool may be damaged.

For separating the flange portion 11*c* and the body portion 11*b* from each other while avoiding cutting of the residual mandrel 12', there is adopted a method in which the body portion 11*b* and the flange portion 11*c* are cut from each other while the position of contact of the cutting edge relative to the periphery of the body portion 11*b* is changed into the circumferential direction. However, this cutting method is disadvantageous in that much time and labor are required for the cutting work because the separation of the body portion 11*b* and the flange portion 11*c* cannot be done by a single cutting operation.

If the residual mandrel 12' remaining in the through hole 11*a* of the blind rivet body 11 is short and is present on only the body portion 11*b* side with respect to the cut position between the flange portion 11*c* and the body portion 11*b* and if the cutting edge of the cutting tool does not come into abutment with the residual mandrel 12' in the cutting work, the flange portion 11*c* and the body portion 11*b* can be cut from each other in a relatively easy manner even by the use of the above type of a cutting tool.

However, even if the flange portion 11*c* and the body portion 11*b* are cut from each other by the cutting tool, since the body portion 11*b* of the blind rivet 10 bites into and is caulked to the base metals 1 and 2 by the residual mandrel 12', it is necessary to perform a secondary work of tapping the blind rivet body 11 from the base metal 1 side after separation of the flange portion 11*c* and pulling out the blind rivet body 11 from the clamping holes 1*a* and 2*a* of the base metals 1 and 2.

SUMMARY OF THE INVENTION

It is an object of the present invention to provide a blind rivet disassembling device and method and a production system using the disassembling method, capable of removing a blind rivet clamped to a base metal easily and rapidly from the base metal.

For achieving the above-mentioned object, in the first aspect of the present invention, there is provided a blind rivet disassembling device wherein a blind rivet body having a body portion and a flange portion, with a through hole being formed through the blind rivet body in an axial direction of the body portion from the body portion toward the flange portion, is inserted into clamping holes formed in base metals, a mandrel having a stem portion and a head portion, the head portion being substantially integral with the stem portion and larger than the diameter of the through hole of the blind rivet body, is inserted into the through hole, the head portion is pulled into the through hole as the mandrel is pulled, so that a peripheral wall of the body portion around the through hole undergoes a plastic deformation and is bulged and the mandrel is broken, allowing a portion of the mandrel to remain as a residual mandrel within the through hole, the base metals are sandwiched by the bulge of the peripheral wall of the body portion and the head portion of the mandrel, and the blind rivet clamped to the base metals is separated from the base metals, the blind rivet disassembling device comprising a cutting means adapted to get in between the flange portion and the base metals and cut the body portion in a direction perpendicular to the axial direction of the body portion toward a center of the through hole, a push-out means for pushing out the residual mandrel from the flange portion toward the bulge along the axial direction of the body portion, a moving means for moving the cutting means toward the center of the through hole, and an advancing means which causes the push-out means to advance into the through hole for pushing out the residual mandrel in interlock with the movement of the cutting means.

According to this construction, since the body portion of the blind rivet is cut after the residual mandrel is pushed out from the through hole, the body portion can be cut easily without requiring a large cutting force and the cutting edge portion of the cutting means can be prevented from being damaged.

In the second aspect of the present invention there is provided, in combination with the first aspect, a blind rivet disassembling device wherein a cutout portion which permits advance and retreat of the push-out means is formed in an edge portion of the cutting means.

According to this construction, it is possible to avoid interference between the cutting means and the push-out means at the time of cutting the body portion.

In the third aspect of the present invention there is provided, in combination with the first aspect, a blind rivet disassembling device wherein, after the cutting of the body portion, the advancing means causes the push-out means to be retracted from the through hole in interlock with the movement of the cutting means in a direction away from the center of the through hole.

According to this construction, the push-out means can be advanced and retreated with respect to the through hole in interlock with the movement of the cutting means.

In the fourth aspect of the present invention there is provided, in combination with the first aspect, a blind rivet disassembling device further including a flange portion removing means for removing from the push-out means the flange portion which remains on the push-out means after separation from the body portion.

According to this construction, the flange portion having been cut and remaining in the push-out means can be removed from the push-out means by the flange portion removing means.

In the fifth aspect of the present invention there is provided a blind rivet disassembling device wherein a blind rivet body having a body portion and a flange portions with a through hole being formed through the blind rivet body in an axial direction of the body portion from the body portion toward the flange portion, is inserted into clamping holes formed in base metals, a mandrel having a stem portion and a head portion, the head portion being substantially integral with the stem portion and larger than the diameter of the through hole of the blind rivet body, is inserted into the through hole, the head portion is pulled into the through hole as the mandrel is pulled, so that a peripheral wall of the body portion around the through hole undergoes a plastic deformation and is bulged and the mandrel is broken, allowing a portion of the mandrel to remain as a residual mandrel within the through hole, the base metals are sandwiched by the bulge of the peripheral wall of the body portion and the head portion of the mandrel, and the blind rivet clamped to the base metals is separated from the base metals, the blind rivet disassembling device comprising a cutting means having at least a first blade and a second blade both disposed in an opposed relation to each other with the body portion therebetween, the first and second blades being each formed with a semicircular cutout portion nearly centrally, a moving means which causes the first and second blades to move toward a center of the through hole so that the body portion is cut and separated from the flange portion by the cutting means, a push-out means adapted to get into the through hole and push out the mandrel from the flange portion toward the bulge along the through hole, the push-out means having an outside diameter smaller than the diameter of the through hole and also smaller than the diameter of an aperture formed by the semicircular cutout portions of the first and second blades, and an interlocking means which, in interlock with the cutting motion of the cutting means, causes the push-out means to get into the through hole until the mandrel is removed from the blind rivet body.

As a result, when the cutting means moves in the cutting direction in the cutting work, the residual mandrel is pushed out from the through hole by the push-out member, so that the body portion can be cut without damage to the blade edges. Besides, since the semicircular cutout portions are formed in the first and second blades, it is possible to avoid interference of the first and second blades with the push-out means at the time of cutting the body portion.

In the sixth aspect of the present invention there is provided, in combination with the fifth aspect, a blind rivet disassembling device wherein the push-out means is retracted from the through hole in interlock with a retreating motion of the cutting member.

According to this construction, the push-out means can be retracted from the through hole in interlock with the movement of the cutting means in a direction opposite to the cutting direction.

In the seventh aspect of the present invention there is provided, in combination with the fifth aspect, a blind rivet disassembling device further including a flange portion removing means for removing the flange portion from the push-out means, the flange portion having been separated from the body portion and with the push-out means being present therewithin, and an interlocking means which causes the flange portion removing means to move in the axial direction of the body portion in interlock with a retreating motion of the cutting means by the moving means.

According to this construction, since the flange portion removing means removes automatically the residual flange portion from the push-out means in interlock with the movement of the cutting means in a direction opposite to the cutting direction, it is possible to make a quick shift to preparations for the disassembling work for another blind rivet.

In the eighth aspect of the present invention there is provided a blind rivet disassembling device wherein a blind rivet body having a body portion and a flange portion, with a through hole being formed through the blind rivet body in an axial direction of the body portion from the body portion toward the flange portion, is inserted into clamping holes formed in base metals, a mandrel having a stem portion and a head portion, the head portion being substantially integral with the stem portion and larger than the diameter of the through hole of the blind rivet body, is inserted into the through hole, the head portion is pulled into the through hole as the mandrel is pulled, so that a peripheral wall of the body portion around the through hole undergoes a plastic deformation and is bulged and the mandrel is broken, allowing a portion of the mandrel to remain as a residual mandrel within the through hole, the base metals are sandwiched by the bulge of the peripheral wall of the body portion and the head portion of the mandrel, and the blind rivet clamped to the base metals is separated from the base metals, the blind rivet disassembling device comprising a cutting means provided with a pair of blades, the blades being opposed to each other and capable of coming into engagement with each other, a blades engaging/disengaging means which causes the paired blades to be engaged with and disengaged from each other in a direction nearly perpendicular to the axial direction of the body portion of the blind rivet body, a push-out pin inserted into the through hole and adapted to push out the residual mandrel at a position where the paired blades come into substantial contact with the outer peripheral surface of the flange portion, and a push-out pin advancing/retreating means which causes the push-out pin to advance from the flange portion toward the bulge along the through hole in interlock with an advancing motion of the paired blades by the blades engaging/disengaging means and which causes the push-out pin to retreat in interlock with a retreating motion of the paired blades, the cutting means being constituted by a pair of grip arms having a pair of blades formed at one ends thereof and also having grip portions at the opposite ends thereof, the paired grip arms further having crossing portions where the paired grip arms cross each other at a position close to the paired blades, the crossing portions of the paired grip arms being supported pivotably through a pivot shaft, and the blades engaging/disengaging means comprising levers adapted to turn with the crossing portions as fulcrums.

According to this construction, the body portion of the blind rivet can be cut on the basis of the principle of a lever, that is, a smaller cutting force suffices to cut the body portion.

In the ninth aspect of the present invention there is provided, in combination with the eighth aspect, a blind rivet disassembling device wherein the push-out pin advancing/retreating means is constituted by a resilient member which imparts a biasing force to the cutting means, the biasing force acting in a direction to disengage the blades from each other.

According to this construction, since a pair of push-out links are constituted by resilient members, the paired grip arms can be urged at all times in a direction to disengage the blades from each other, whereby not only the cutting work can be done more quickly but also the structure of the push-out links can be simplified.

In the tenth aspect of the present invention there is provided a blind rivet disassembling device wherein a blind rivet body having a body portion and a flange portion, with a through hole being formed through the blind rivet body in an axial direction of the body portion from the body portion toward the flange portion, is inserted into clamping holes formed in base metals, a mandrel having a stem portion and a head portion, the head portion being substantially integral with the stem portion and larger than the diameter of the through hole of the blind rivet body, is inserted into the through hole, the head portion is pulled into the through hole as the mandrel is pulled, so that a peripheral wall of the body portion around the through hole undergoes a plastic deformation and is bulged and the mandrel is broken, allowing a portion of the mandrel to remain as a residual mandrel within the through hole, the base metals are sandwiched by the bulge of the peripheral wall of the body portion and the head portion of the mandrel, and the blind rivet clamped to the base metals is separated from the base metals, the blind rivet disassembling device comprising a cutting means provided with a pair of blades, the blades being opposed to each other and capable of coming into engagement with each other, a blade engaging/disengaging means which causes the paired blades to be engaged with and disengaged from each other in a direction nearly perpendicular to the axial direction of the body portion of the blind rivet body, a push-out pin inserted into the through hole and adapted to push out the residual mandrel at a position where the paired blades come into substantial contact with the outer peripheral surface of the flange portion, and a push-out pin advancing/retreating means which causes the push-out pin to advance from the flange portion toward the bulge along the through hole in interlock with an advancing motion of the paired blades by the blades engaging/disengaging means and which causes the push-out pin to retreat in interlock with a retreating motion of the paired blades, the push-out pin advancing/retreating means comprising a first slider link mechanism and a second slider link mechanism, the first slider link mechanism having a pair of push-out links which are in a relation of turning pair to the push-out pin and to a pair of grip arms with the push-out pin as a slider, the second slider link mechanism having a pair of holding links which are in a relation of turning pair to a holding member with the holding member as a slider, the holding member holding the push-out pin slidably and being moved in a direction opposite to the retracted direction of the push-out pin by the paired grip arms.

According to this construction, not only it is possible to let the push-out pin slide stably but also the flange portion which remains on the push-out pin can be removed automatically from the push-out pin.

In the eleventh aspect of the present invention there is provided, in combination with the eighth aspect, there is provided a blind rivet disassembling device wherein edges of the blades are formed in a shape adapted to bite into a boundary plane between the flange portion and the base metals.

According to this construction, it is possible to let the edges of the blades easily get into the boundary plane between the flange portion and the base metals.

In the twelfth aspect of the present invention there is provided a blind rivet disassembling method wherein a blind rivet body having a body portion and a flange portion, with a through hole being formed through the blind rivet body in an axial direction of the body portion from the body portion toward the flange portion, is inserted into clamping holes formed in base metals, a mandrel having a stem portion and a head portion, the head portion being substantially integral with the stem portion and larger than the diameter of the through hole of the blind rivet body, is inserted into the through hole, the head portion is pulled into the through hole as the mandrel is pulled, so that a peripheral wall of the body portion around the through hole undergoes a plastic deformation and is bulged and the mandrel is broken, allowing a portion of the mandrel to remain as a residual mandrel within the through hole, the base metal are sandwiched by the bulge of the peripheral wall of the body portion and the head portion of the mandrel, and the blind rivet clamped to the base metals is separated from the base metals, the blind rivet disassembling method being characterized in that, while a push-out means is inserted into the through hole to push out the residual mandrel along the through hole, blades are allowed to get in between the flange portion and the base metals and nip and cut the body portion of the blind rivet body in a direction perpendicular to the axial direction of the body portion.

According to this construction there is obtained the same effect as in the eleventh aspect.

In the thirteenth aspect of the present invention there is provided, in combination with the twelfth aspect, a blind rivet disassembling method wherein after the cutting operation by the blades and with the push-out means still lying within the through hole, the remaining flange portion is removed from the push-out means.

According to this construction there is obtained the same effect as in the fourth aspect.

In the fourteenth aspect of the present invention there is provided a production system wherein a blind rivet body having a body portion and a flange portion, with a through hole being formed through the blind rivet body in an axial direction of the body portion from the body portion toward the flange portion, is inserted into a clamping holes formed in base metals, a mandrel having a stem portion and a head portion, the head portion being substantially integral with the stem portion and larger than the diameter of the through hole of the blind rivet body, is inserted into the through hole, the head portion is pulled into the through hole as the mandrel is pulled, so that a peripheral wall of the body portion around the through hole undergoes a plastic deformation and is bulged and the mandrel is broken, allowing a portion of the mandrel to remain as a residual mandrel within the through hole, the base metals are sandwiched by the bulge of the peripheral wall of the body portion and the head portion of the mandrel, and the blind rivet clamped to the base metals is removed from the base metals, thereby allowing the base metals to be recovered, the production system being characterized in that the clamped condition of the blind rivet to the base metals is checked and if it is found to be defective, the residual mandrel is pushed out from the through hole, the body portion of the blind rivet body is napped and cut in a direction perpendicular to the axial direction of the body portion, then the blind rivet is removed from the base metals, and the base metals are recovered.

According to this construction, the base metal can be recovered easily.

In the fifteenth aspect of the present invention there is provided a production system wherein a blind rivet body having a body portion and a flange portion, with a through hole being formed through the blind rivet body in an axial direction of the body portion from the body portion toward the flange portion, is inserted into clamping holes formed in base metals, a mandrel having a stem portion and a head portions the head portion being substantially integral with the stem portion and larger than the diameter of the through hole of the blind rivet body, is inserted into the through hole, the head portion is pulled into the through hole as the mandrel is pulled, so that a peripheral wall of the body portion around the through hole undergoes a plastic deformation and is bulged and the mandrel is broken, allowing a portion of the mandrel to remain as a residual mandrel within the through hole, the base metals are sandwiched by the bulge of the peripheral wall of the body portion and the head portion of the mandrel, and the blind rivet clamped to the base metals is removed from the base metals thereby allowing the base metals to be recovered, the production system being characterized in that the residual mandrel is pushed out from the through hole, the body portion of the blind rivet body is nipped and cut in a direction perpendicular to the axial direction of the body portion, the blind rivet is removed from the base metals, and the base metals are recovered.

According to this construction, the base metals can be recovered easily after disassembly and removal of the blind rivet.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Embodiments of the present invention will be described hereinunder with reference to the accompanying drawings.

[Embodiment: 1 of Blind Rivet Disassembling Device]

Figure 1:
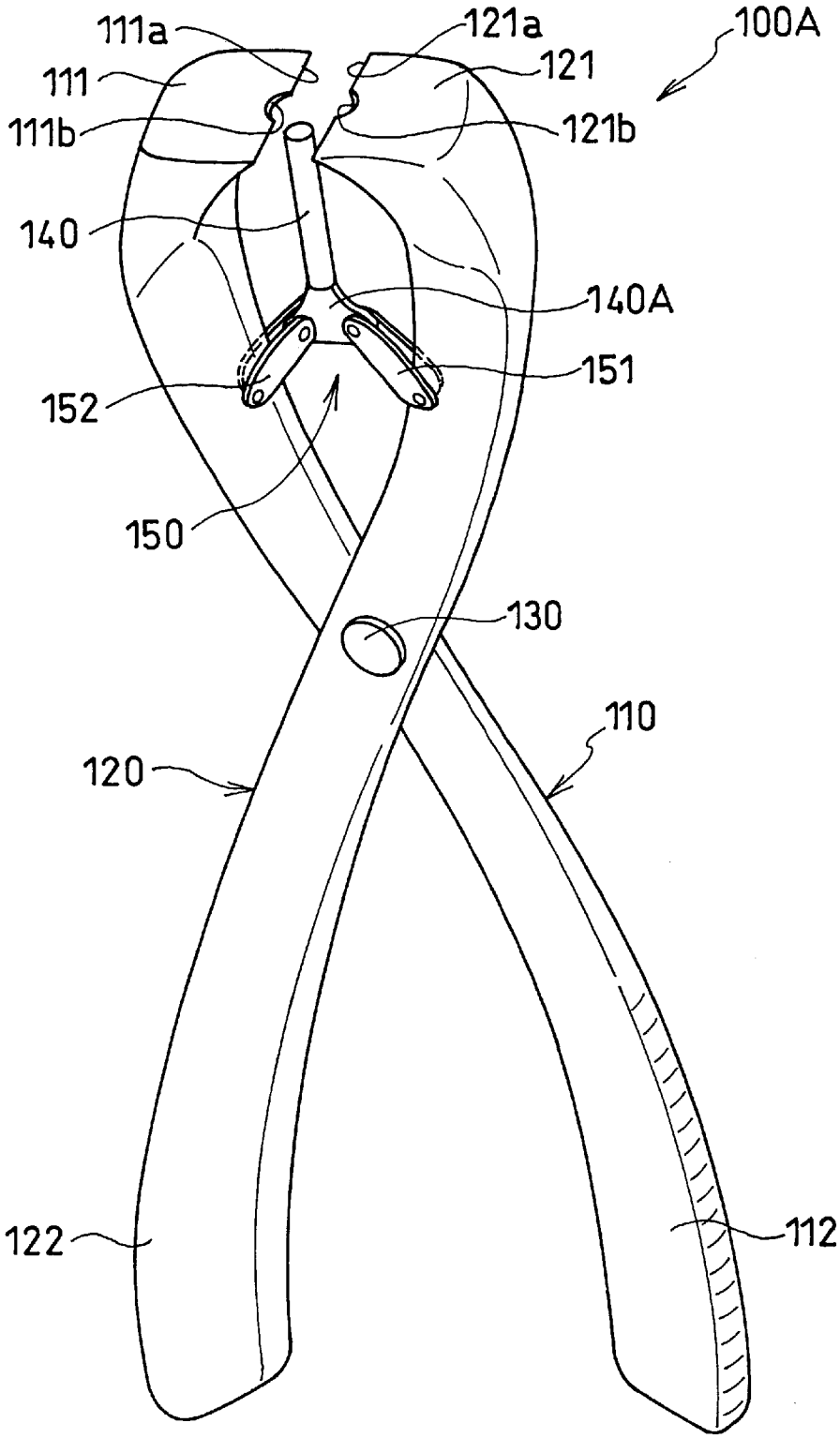
FIG. 1 is a perspective view showing an appearance of a blind rivet disassembling device according to the first embodiment of the present invention.

In FIG. 1, the reference numeral 100A denotes a blind rivet disassembling device. The blind rivet disassembling device 100A has a pair of grip arms 110 and 120 as blade members (cutting means). The grip arms 110 and 120 have a pair of blades 111 and 121 at respective one ends, which blades 111 and 121 are adapted to come into engagement with each other, and also have grip portions (moving means, moving members) at respective opposite ends to be gripped by a worker. The grip arms 110 and 120, which function as blade engaging/disengaging means, have crossing portions on respective sides closer to the blades (first and second blades) 111 and 121, the crossing portions being supported pivotably by a pivot shaft 130.

In the blind rivet disassembling device 100A, by turning the paired grip arms 110 and 120 with the pivot shaft 130 as a fulcrum in a direction in which the respective opposite ends move toward or away from each other, the paired blades 111 and 121 are moved toward or away from each other and gripping forces applied to, the grip portions 112 and 122 are enhanced on the basis of the principle of a lever, so that edges 111*a* and 121*a* of the blades 111 and 121 are moved into contact with or away from each other.

Figure 14A:
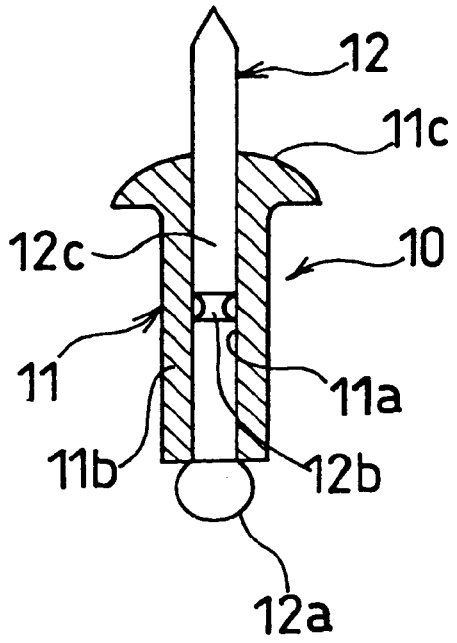
FIG. 14(a) (Prior Art)
FIG. 14 shows a conventional blind rivet, in which FIG. 14(*a*) is a sectional view showing a state before clamping the blind rivet to base metals and FIG. 14(*b*) is a sectional view showing a state after clamping the blind rivet to the base metals.
Figure 14B:
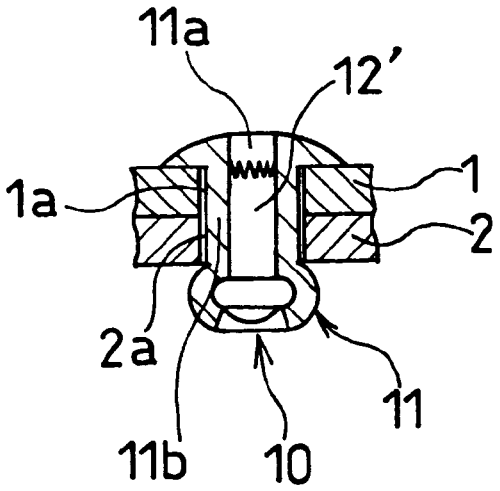
FIG. 14(b) (Prior Art)
Figure 15A:
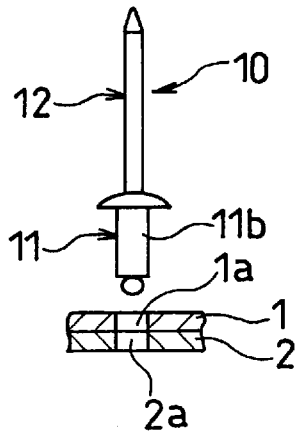
FIG. 15(a) (Prior Art)
FIG. 15 shows a conventional base metal clamping process using a blind rivet, in which FIG. 15(*a*) is an explanatory diagram showing a state just before insertion of the blind rivet into a clamping hole formed in the base metal, FIG. 15(*b*) is an explanatory diagram showing a state just before chucking an end portion of a mandrel of the blind rivet with a jaw member of a rivet clamping device, FIG. 15(*c*) is an explanatory diagram showing a state in which the stem portion of the mandrel has been chucked by the jaw member, and FIG. 15(*d*) is an explanatory diagram showing a state in which a projecting end of a body portion of the blind rivet has been bulged and caulked by breakage of the mandrel at a constriction of the mandrel which breakage is induced when the stem portion of the mandrel is pulled by the jaw member.
Figure 15B:
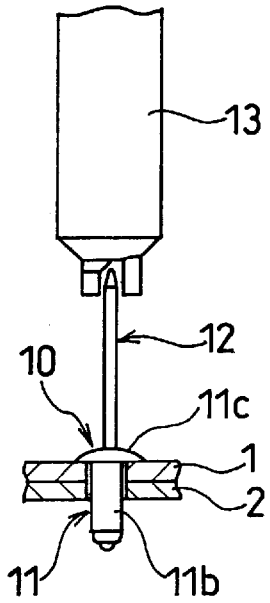
FIG. 15(b) (Prior Art)
Figure 15C:
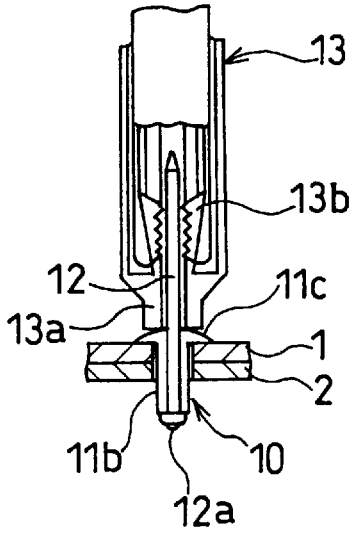
FIG. 15(c) (Prior Art)
Figure 15D:
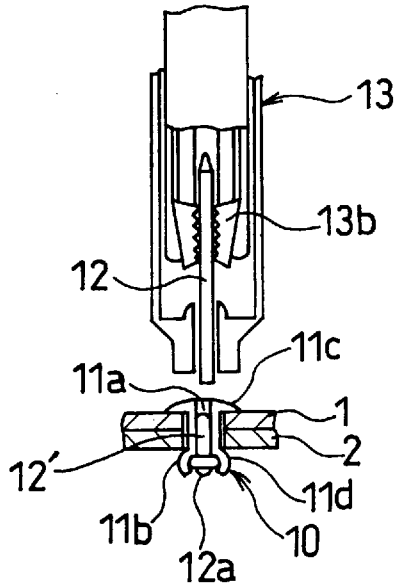
FIG. 15(d) (Prior Art)
Figure 16:
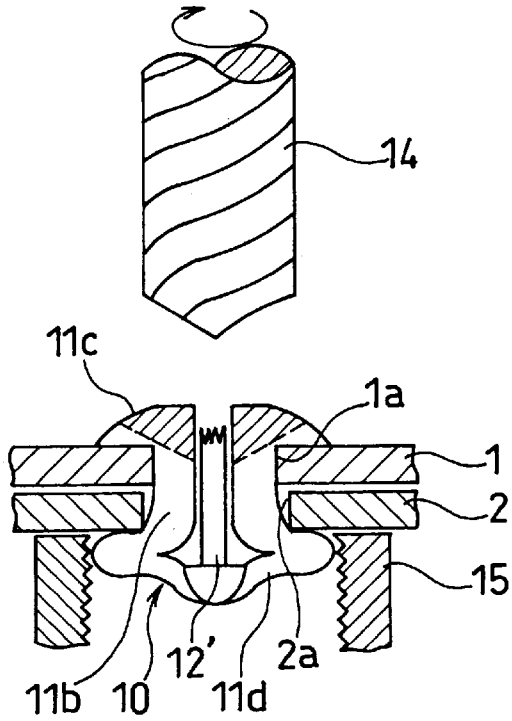
FIG. 16 (Prior Art)
FIG. 16 is a diagram showing a state in which a head portion of a blind rivet is cut with a drill to disassemble the blind rivet in accordance with a conventional method.
Figure 17:
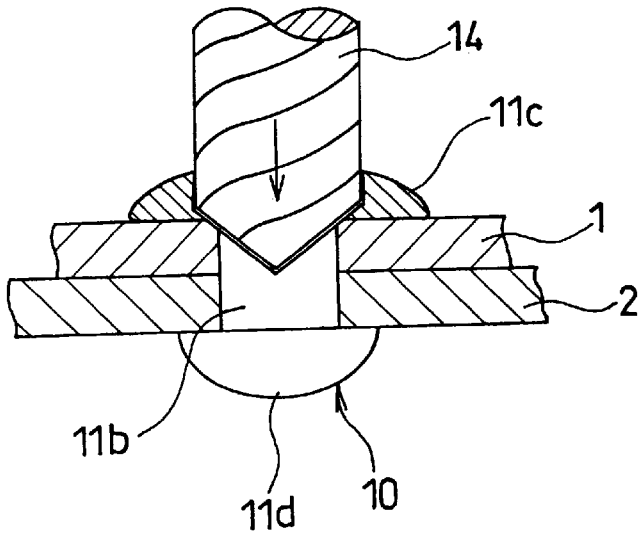
FIG. 17 (Prior Art)
FIG. 17 is a diagram for explaining an inconvenience involved in the disassembling method using a drill which is shown in FIG. 16.
Figure 18:
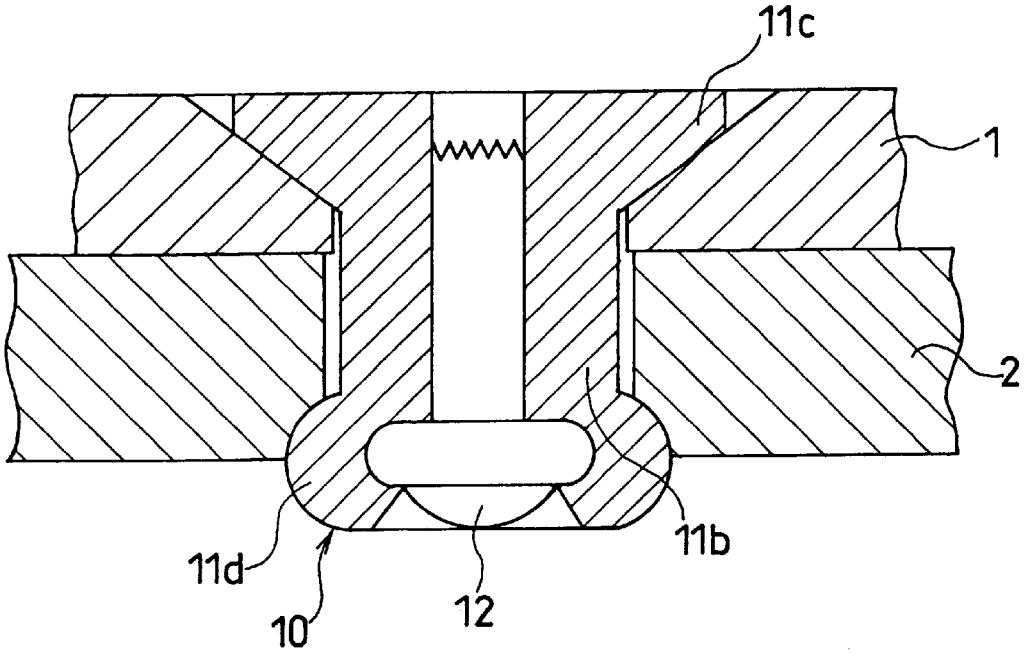
FIG. 18 (Prior Art)
FIG. 18 is an explanatory diagram for explaining an inconvenience involved in a conventional blind rivet disassembling work which blind rivet has a flange portion of a flat shape.

In the blind rivet disassembling device 100A, a push-out pin (push-out means, push-out member) 140 is disposed at a position close to the edges 111*a* and 121*a* of the paired blades 111 and 121 and between both blades. The push-out pin 140 is inserted into a through hole 11*a* shown in FIG. 14(*b*) and functions to push out a residual mandrel 12' which remains within the through hole 11*a*.

The push-out pin 140 has an outside diameter smaller than the diameter of the through hole 11*a* and smaller than the diameter of an aperture which is defined by semicircular cutout portions.

The push-out pin 140 is moved forward and backward by a push-out pin advancing/retreating means (advancing means) 150. The push-out pin advancing/retreating means 150 has a pair of push-out links (interlocking members) 151 and 152. One ends of the paired push-out links 151 and 152 are connected pivotably to a triangular base plate 140A of the push-out pin 140. Opposite ends of the push-out links 151 and 152 are connected pivotably to the grip arms 110 and 120 on the sides closer to the blades 111 and 121.

The push-out pin advancing/retreating means 150 is constituted by a kind of a slider link mechanism in which the paired push-out links 151 and 152 are in a relation of turning pair to the push-out pin 140 and the paired grip arms 110 and 120 and in which the push-out pin 140 serves as a slider.

A front end portion of the push-out pin 140 has a shape capable of being fitted into the through hole 11*a*. In the edges of the blades 111 and 121 are formed semicircular cutout portions 111*b* and 121*b* which permit advance and retreat of the push-out pin 140, as shown in FIG. 1.

Figure 2A:
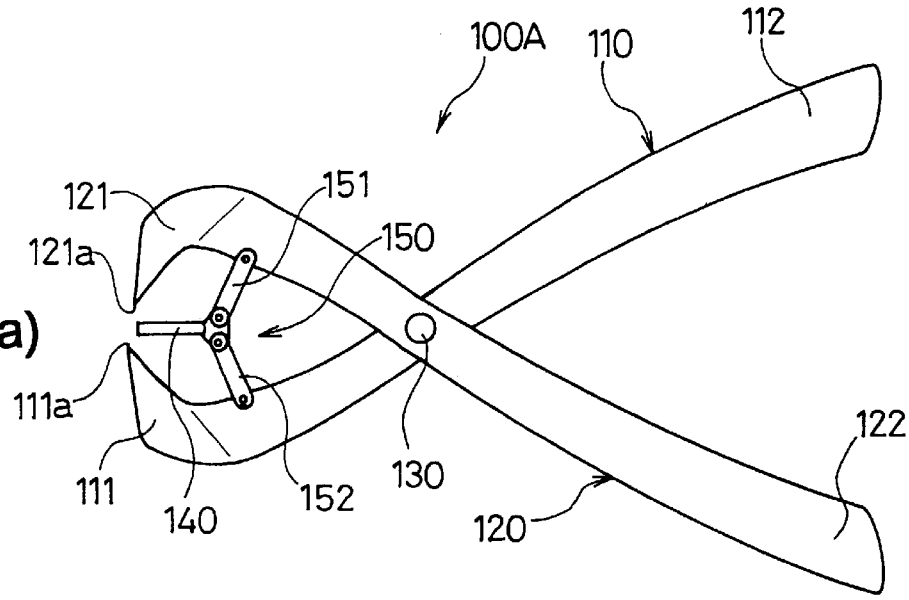
FIG. 2(*a*) is a plan view showing an opened state of edges of blades used in the blind rivet disassembling device shown in FIG. 1, FIG. 2(*b*) is a plan view showing a closed state of the blade edges, and FIG. 2(*c*) is a plan view of the blades and edges shown in FIG. 2(*b*) in a closed state of the edges as seen in the direction of arrows X in FIG. 2(*b*)
Figure 2B:
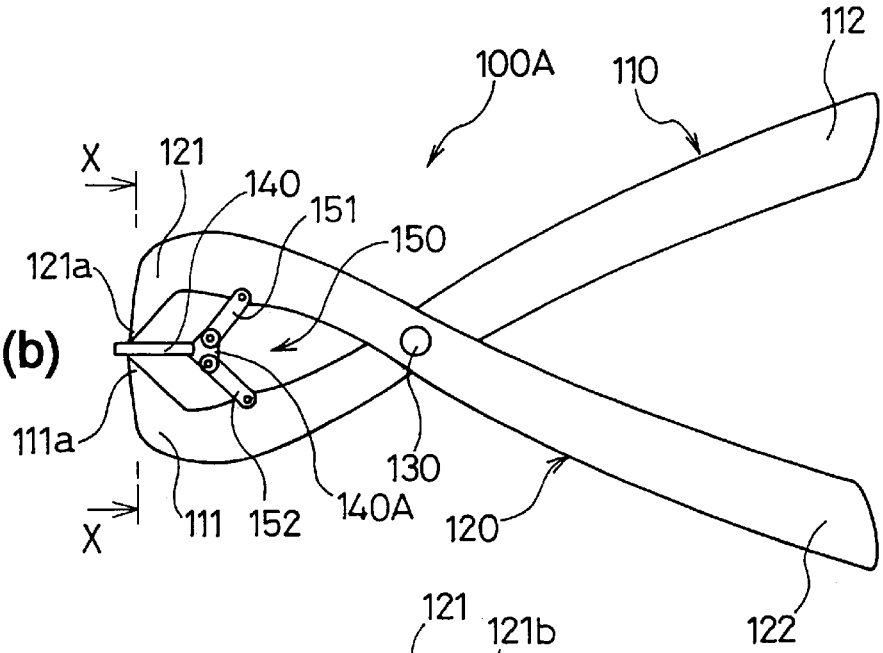
Figure 2C:
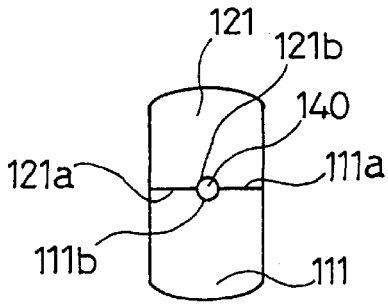

When the edges 111*a* and 121*a* of the blades 111 and 121 are spaced apart widely from each other as in FIG. 2(*a*), the push-out pin 140 is retreated to a position between the paired grip arms 110 and 120 opposed to each other by the push-out pin advancing/retreating means 150, while when the blade edges 111*a* and 121*a* are in contact with each other, the push-out pin 140 is advanced from the position between the opposed grip arms 112 and 121. A pair of cutout portions 111*b* and 121*b* are formed so as to define an aperture of a diameter somewhat larger than the outside diameter of the push-out pin 140 in a mutually contacted state of the blade edges 111*a* and 121*a*, as shown in FIG. 2(*c*). Interference between the edges 111*a*, 121*a* and the push-out pin 140 is avoided in the presence of the cutout portions 111*b* and 121*b*.

Figure 3A:
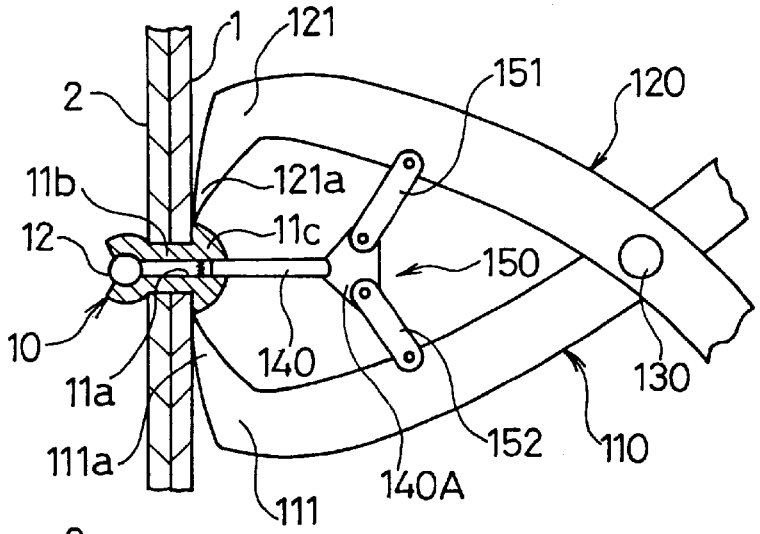
FIG. 3 shows a blind rivet cutting process using the blind rivet disassembling device shown in FIG. 1, in which FIG. 3(*a*) is an explanatory diagram showing a state in which the blade edges are put between a flange portion of the blind rivet and a base metal, FIG. 3(*b*) is an explanatory diagram showing a state in which the blade edges are caused to bite into a body portion of the blind rivet by squeezing grip arms of the blind rivet disassembling device, and FIG. 3(*c*) is an explanatory diagram showing a cut state of the blind rivet body portion by squeezing the grip arms more strongly than in the state shown in FIG. 3(*b*)
Figure 3B:
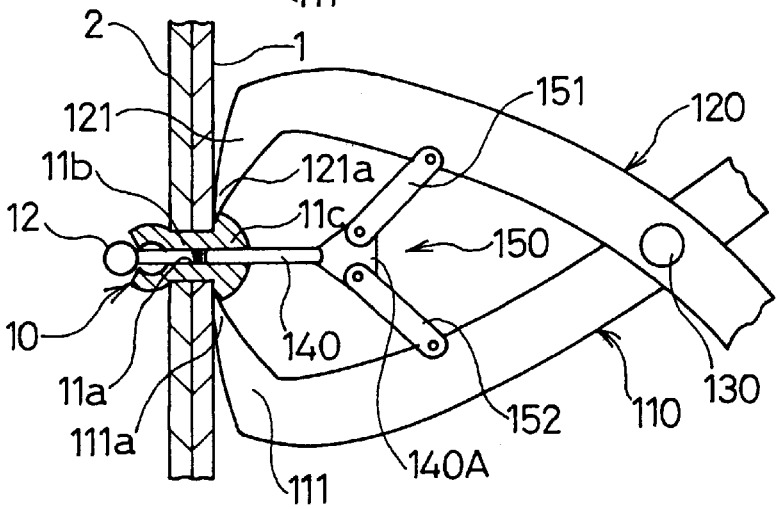
Figure 3C:
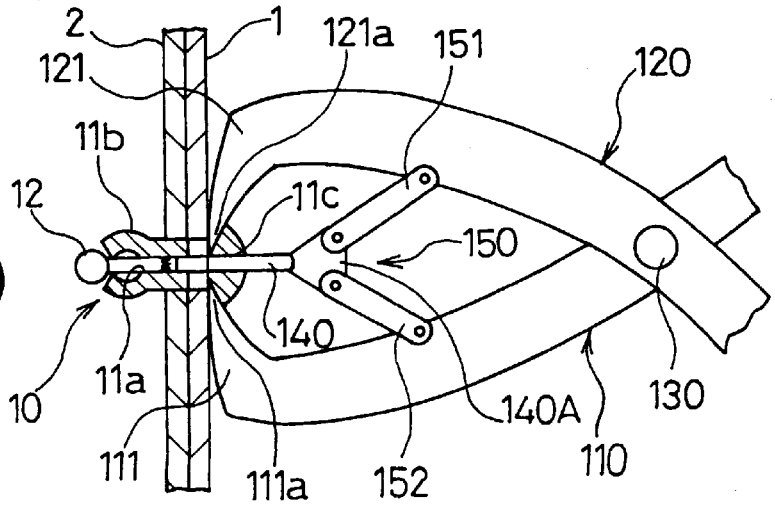

As shown in FIG. 3(*a*), the paired push-out links 151 and 152 are disposed so that the front end portion of the push-out pin 140 lies in a position in which it can be inserted into the through hole 11*a* in a contacted state of the edges 111*a* and 121*a* with an outer peripheral surface of a flange portion 11*c* of a blind rivet 10.

In the blind rivet disassembling device 100A, in order that the push-out links 151 and 152 may not turn largely to the grip portions 112 and 122 side beyond their change point at the time of retreat of the push-out pin 140, a turning quantity of each of the grip arms 110 and 120 or each of the push-out links 151 and 152, which constitute the push-out pin advancing/retreating means 150 is restricted by a stopper (not shown).

FIGS. 3(*a*) to 3(*c*) show a process of cutting a body portion 11*b* of the blind rivet 10 with use of the blind rivet disassembling device 100A.

First, as shown in FIG. 3(*a*), with the front end portion of the push-out pin 140 fitted in the through hole 11*a* of the blind rivet 10, the edges 111*a* and 121*a* of the blades 111 and 121 are positioned between a base metal 1 and the flange portion 11*c* of the blind rivet 10.

Next, the grip portions 112 and 122 of the grip arms 110 and 120 are squeezed strongly, resulting in that the grip arms 110 and 120 turn with the pivot shaft 130 as a fulcrum in a direction in which the edges 111*a* and 121*a* of the blades 111 and 121 approach each other. That is, the edges 111*a* and 121*a* move toward a center of the through hole in a direction perpendicular to the axial direction of the body portion of the blind rivet. As a result, the edges 111*a* and 121*a* come into substantial contact with the outer peripheral surface of the flange portion 11*c* and bite in between the base metal 1 and the flange portion 11*c*, as shown in FIG. 3(*b*).

Interlockedly with this turning motion of the grip arms 110 and 120 the push-out pin advancing/retreating means 150 pushes the front end portion of the push-out pin 140 from the flange portion 11*c* toward a bulge 11*d* in the axial direction of the body portion of the blind rivet. That is, in interlock with the turning motion of the grip arms 110 and 120, the front end portion of the push-out pin 140 advances from a portion of the through hole 11*a* surrounded by an inner peripheral wall of the flange portion 11*c* up to a portion of the through hole 11*a* surrounded by an inner peripheral wall of the blind rivet body portion, so that the residual mandrel 12' is pushed out from the through hole 11*a* in the axial direction of the blind rivet body portion from the flange portion 11*c* toward the bulge 11*d* by the push-out pin 140 and is retreated from a cutting position where a portion to be broken (corresponding to a constriction 12*b*) of the residual mandrel 12' is cut by the edges 111*a* and 121*a* as in FIG. 3(*b*), thus is positioned where there is no interference in the cutting operation by the edges 111*a* and 121*a*.

In this state shown in FIG. 3(*b*), if the grip portions 112 and 122 are squeezed more strongly, the blade edges 111*a* and 121*a* bite in a peripheral wall of the blind rivet body portion 11*b*, with the result that a boundary portion between the body portion 11*b* and the flange portion 11*c* is nipped and cut by the edges 111*a* and 121*a*, as shown in FIG. 3(*c*).

At this time, the front end portion of the push-out pin 140 is further pushed in toward the opposite side of the through hole 11*a* by the push-out pin advancing/retreating means 150, whereby the residual mandrel 12' is pushed out from the through hole 11*a*.

The body portion 11*b* is cut while being throttled by the edges 111*a* and 121*a* of the blades 111 and 121, so that an outside diameter of the cut portion of the body portion 11*b* after the cutting becomes smaller than that before the cutting. The smaller the outside diameter of the push-out pin 140 relative to the diameter of the through hole 11*a*, the larger the outside diameter of the cut portion of the body portion 11*b* after the cutting. By the reduction in outside diameter of the body portion 11*b* it becomes easy to remove the body portion 11*b* from base metals 1 and 2 after the cutting.

According to the blind rivet disassembling device 100A, the edges 111*a* and 121*a* of the blades 111 and 121 are prevented from abutting the residual mandrel 12' at the time of cutting the body portion 11*b* and the flange portion 11*c* from each other and there is no fear of the edges 111*a* and 121*a* being damaged when an attempt is made to cut the mandrel 12' forcibly, nor is required a large cutting force in the cutting operation. The body portion 11*b* and the flange portion 11*c* of the blind rivet 10 clamped to the base metals 1 and 2 can be cut easily by a single cutting operation.

[Embodiment 2 of Blind Rivet Disassembling Device]

Figure 4A:
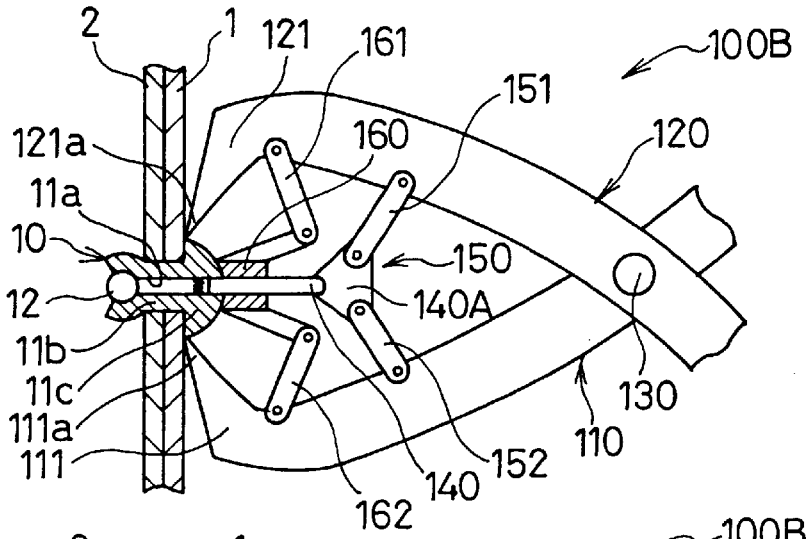
FIG. 4 shows a cutting process using a blind rivet disassembling device according to the second embodiment of the present invention, in which FIG. 4(*a*) is an explanatory diagram showing a state in which blade edges are put between a flange portion of the blind rivet and a base metal, FIG. 4(*b*) is an explanatory diagram showing a state in which the blade edges are caused to bite into a body portion of the blind rivet by squeezing grip arms of the blind rivet disassembling device, and FIG. 4(*c*) is an explanatory diagram showing a cut state of the blind rivet body portion by squeezing the grip arms more strongly than in the state shown in FIG. 4(*b*)
Figure 4B:
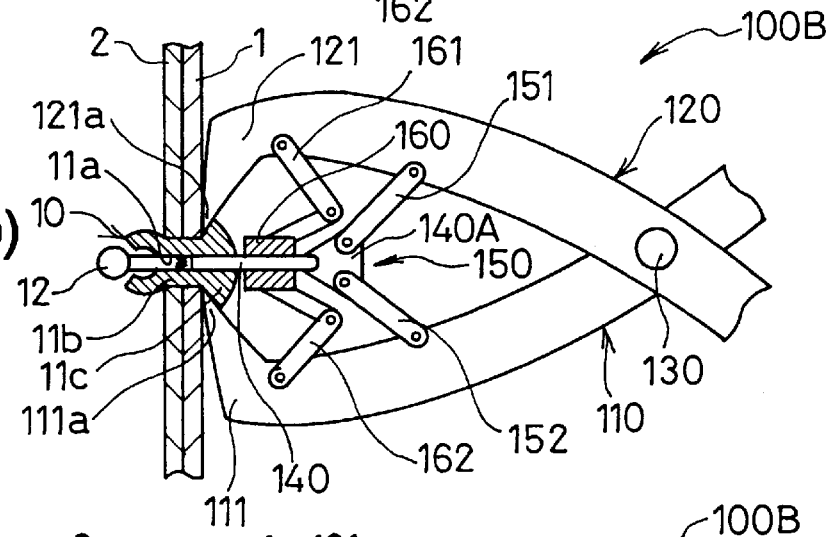
Figure 4C:
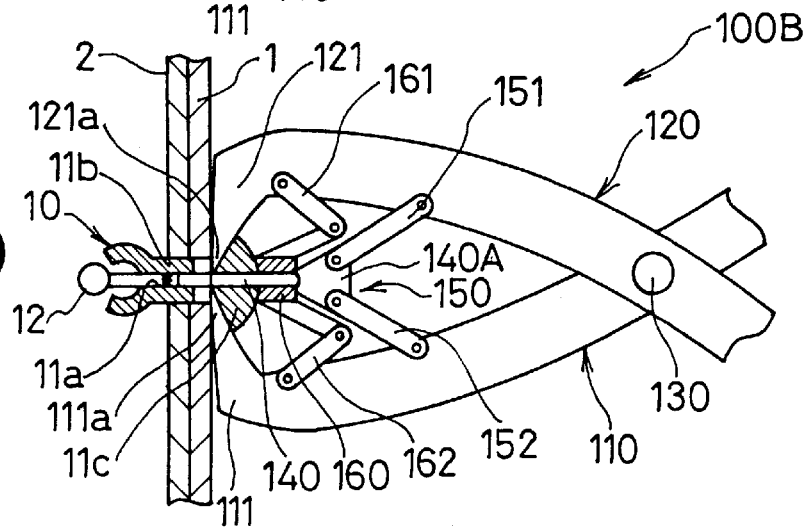

FIGS. 4(*a*) to 4(*c*) illustrate a construction of a blind rivet disassembling device 100B according to Embodiment 2 of the present invention.

In the blind rivet disassembling device 100A of Embodiment 1 shown in FIGS. 1 to 3(*c*), the flange portion 11*c* separated from the body portion 11*b* after the cutting of the body portion remains fitted on the push-out pin 140 with the grip arms 110 and 120 kept open, as shown in FIG. 3(*c*).

Thus, in the case of the blind rivet disassembling device 100A, it is necessary for the worker to later pull out and remove the flange portion 11*c* which remains on the push-out pin 140.

The blind rivet disassembling device 100B is constructed in such a manner that when the grip arms 110 and 120 are opened and restored to the original positions after the cutting of the body portion 11*b*, the flange portion 11*c* which remains on the push-out pin 140 is pulled out automatically from the push-out pin 140.

More specifically, the blind rivet disassembling device 100B has a second slider link mechanism. As shown in FIGS. 4(*a*) to 4(*c*), the second slider link mechanism comprises a holder member 160 which holds the push-out pin 140 slidably and a pair of holding links (interlocking members) 161 and 162 which are in a relation of turning pair to the holder member 160. In the second slider link mechanism, the holder member 160 is advanced or retreated as a slider in a direction opposite to the advancing or retreating direction of the push-out pin 140 by both paired grip arms 110 and 120 and paired holding links 161 and 162.

In the blind rivet disassembling device 100B shown in FIGS. 4(*a*) to 4(*c*), as to the same components as in the blind rivet disassembling device 100A shown in FIGS. 3(*a*) to 3(*c*), they are identified by the same reference numerals as in the disassembling device 100A and detailed explanations thereof will here be omitted.

The following description is now provided about the operation for cutting the body portion 11*b* with use of the blind rivet disassembling device 100B.

First, as shown in FIG. 4(*a*), the edges 11*a* and 121*a* of the blades 111 and 121 are positioned between the base metal 1 and the flange portion 11*c* of the blind rivet 10 while allowing the front end portion of the push-out pin 140 to fit in the through hole 11*a* of the blind rivet 10.

Next, the grip portions 112 and 122 of the grip arms 110 and 120 are squeezed strongly, with the result that the grip arras 110 and 120 turn with the pivot shaft 130 as a fulcrum in a direction in which the edges 111*a* and 121*a* of the blades 111 and 121 approach each other, Consequently, the edges 111*a* and 121*a* bite in between the base metal 1 and the flange portion 11*c*, as shown in FIG. 4(*b*).

Interlockedly with this turning motion of the grip arms 110 and 120 the push-out pin advancing/retreating means 150 pushes the front end portion of the push-out pin 140 in the axial direction of the blind rivet body portion from the flange portion 11*c* toward the bulge 11*d*. That is, in interlock with the turning motion of the grip arms 110 and 120 the front end portion of the push-out pin 140 advances from a portion of the through hole 11*a* surrounded by the inner peripheral wall of the flange portion 11*c* to a portion of the through hole 11*a* surrounded by the inner peripheral wall of the blind rivet body portion, so that the residual mandrel 12' is pushed out from the through hole 11*a* in the axial direction of the body portion from the flange portion 11*c* toward the bulge 11*d* by the push-out pin 140 and is retreated from the cutting position where the to-be-broken portion (corresponding to a constriction 12*b*) of the residual mandrel 12' is cut by the edges 111*a* and 121*a* as in FIG. 4(*b*) up to a position where the residual mandrel causes no interference in the cutting operation by the edges 111*a* and 121*a*.

In this state shown in FIG. 4(*b*), if the grip portions 112 and 122 are squeezed more strongly, the edges 111*a* and 11*a* bite in the peripheral wall of the blind rivet body portion 11*b*, whereby the boundary portion between the body portion 11*b* and the flange portion 11*c* is cut, as shown in FIG. 4(*c*).

After the cutting of the body portion 11*b*, the grip arms 110 and 120 are opened and restored to the original positions shown in FIG. 4(*a*). Interlockedly with the turning motion of the grip arms 110 and 120 around the pivot shaft 130 in the disengaging direction of the edges 111*a* and 121*a* the front end portion of the push-out pin 140 is pulled in between the paired grip arms 110 and 120 opposed to each other, and in response to this pull-in motion of the push-out pin 140 the holder member 160 slides in the opposite direction, whereby the flange portion 11*c* which remains fitted on the push-out pin 140 is pushed out from the push-out pin 140. Thus, the holder member 160 functions as a means for removing automatically the flange portion 11*c* which remains on the push-out pin 140.

Thus, according to the blind rivet disassembling device 100B, by restoring the grip arms 110 and 120 to their original positions after disassembly of the blind rivet 10, the flange portion 11*c* remaining on the push-out pin 140 is pulled out automatically.

Moreover, according to the blind rivet disassembling device 100B, since the push-out pin 140 is held by both the holder member 160 and the holding links 161 and 162, the advancing and retreating motions of the push-but pin 140 and the engaging and disengaging motions of the blades 111 and 121 can be done in a stable manner. Besides, it is possible to improve the mechanical strength of the push-out pin advancing/retreating means 150.

[Embodiment 3 of Blind Rivet Disassembling Device]

Figure 5:
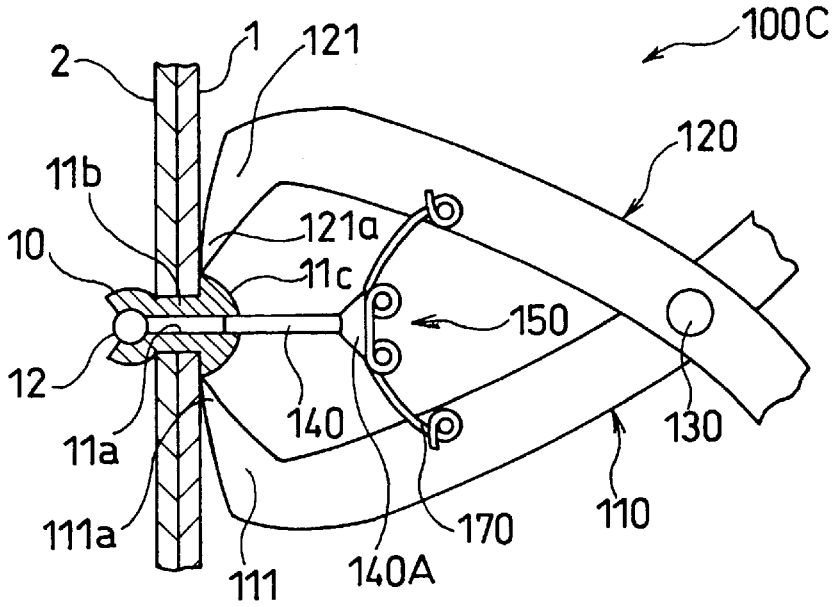
FIG. 5 is a plan view showing a blind rivet disassembling device according to the third embodiment of the present invention.

FIG. 5 illustrates a construction of a blind rivet disassembling device 100C. The blind rivet disassembling device 100C uses a push-out pin advancing/retreating means 150 which uses a coiled spring 170 as a resilient member instead of the paired push-out links 151 and 152 used in the blind rivet disassembling device 100A.

The coiled spring 170 is secured to a pair of grip arms 110 and 120 so as to impart a biasing force to the paired grip arms which biasing force acts in a direction to disengage the blades 111 and 121 from each other.

According to the blind rivet disassembling device 100C, the blades 111 and 121 are kept disengaged from each other as long as the grip arms 110 and 120 are not squeezed. Consequently, at the time of starting the cutting work for the blind rivet 10 and also at the end of the same work it is possible to omit taking the trouble to open the grip arms 110 and 120 which are closed. As a result, it is possible to speed up the cutting work.

Thus, the coiled spring 170 functions not only as the push-out pin advancing/retreating means 150 for advancing and retreating the push-out pin 140 but also as a means for urging the blades 111 and 121 away from each other.

According to the blind rivet disassembling device 100C, therefore, the advancing/retreating motion of the push-out pin 140 and the returning motion of the grip arms 110 and 120 to the original positions can be done by a single coiled spring 170 without using separate and independent resilient members.

Embodiments of the present invention have been described above. It is preferable that the edges 111*a* and 121*a* of the blades 111 and 121 in the blind rivet disassembling devices 100A, 100B and 100C be formed in a shape which permits the blade edges to bite in between the base metal 1 and the flange portion 11*c* easily. With such a shape, it becomes possible to effect the cutting work for the blind rivet 10 more quickly.

Likewise, it is preferable that the front end portion of the push-out pin 140 in each of the blind rivet disassembling devices 100A, 10DB and 100C be formed in a shape which permits easy admission thereof into the through hole 11*a*.

Figure 6A:
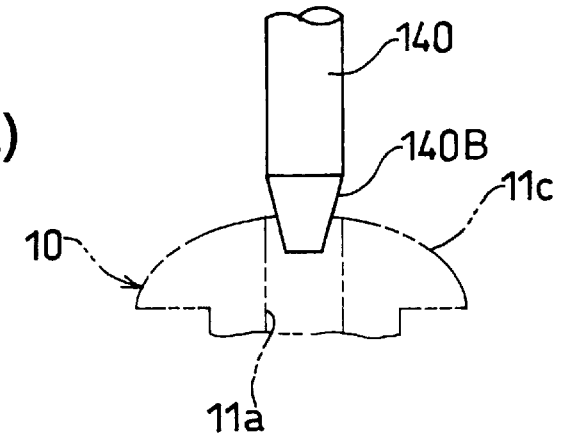
FIG. 6 shows shapes of push-out pins illustrated in FIGS. 1 to 5, in which FIG. 6(*a*) is an explanatory diagram showing a push-out pin having a tapered front end portion and FIG. 6(*b*) is an explanatory diagram showing a push-out pin which is tapered throughout the whole thereof.
Figure 6B:
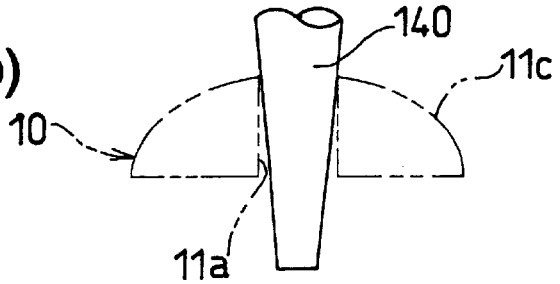

For example, if the front end portion of the push-out pin 140 is formed as a tapered portion 140B, as shown in FIG. 6(*a*), the front end portion can be easily admitted into the through hole 11*a* even if it is somewhat displaced with respect to the through hole.

For example, if the whole of the push-out pin 140 is tapered as in FIG. 6(*b*), the push-out pin 140 can be easily admitted into the through hole 11*a* even if its front end portion is somewhat displaced with respect to the through hole. Further, even when the flange portion 11*c* which has been cut off from the body portion 11*b* still remains in a tightly fitted state on the push-out pin 140, the flange portion 11*c* can be pulled out easily from the push-out pin 140.

[Structure of Blind Rivet]

Figure 7A:
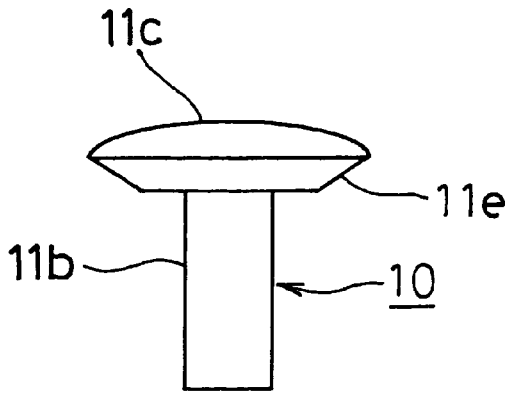
FIG. 7 shows blind rivets which are formed so as to permit blade edges to bite in between a flange portion of the blind rivet and a base metal, in which FIG. 7(*a*) is a side view showing a blind rivet whose flange portion has an inclined portion, FIG. 7(*b*) is a side view showing a blind rivet whose flange portion has a stopped portion, and FIG. 7(*c*) shows a blind rivet whose flange portion has a thick-wall portion.
Figure 7B:
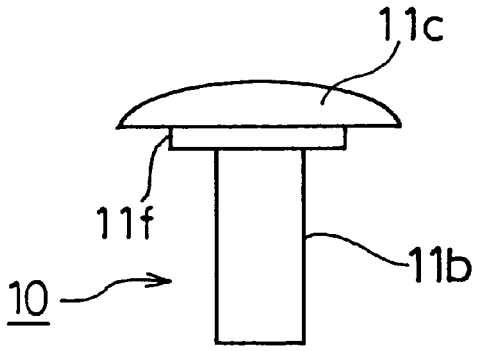
Figure 7C:
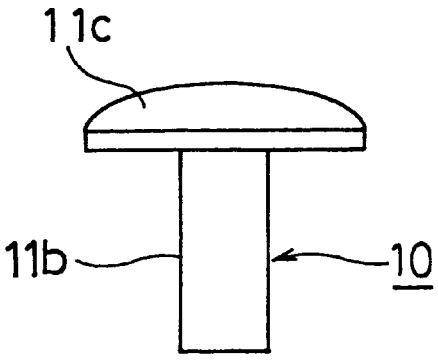

FIGS. 7(*a*) to 10(*c*) illustrate structures of blind rivets 10 for making it easier for the edges 111*a* and 121*a* of the blades 111 and 121 to bite in the boundary plane between the flange portion 11*c* of each blind rivet 10 and the base metal 1. In FIG. 7(*a*), an inclined portion 11*e* is formed on the underside of the flange portion 11*c* which faces the base metal 1. It is preferable that the blind rivet having the inclined portion 11*e* be an iron-based blind rivet rather than an aluminum-based blind rivet. This is because an iron-based blind rivet is hard and therefore it is difficult for the blade edges 111*a* and 121*a* to bite in the boundary portion unless there is provided the inclined portion 21*e*.

Instead of forming the inclined portion 11*e* on the underside of the blind rivet flange portion 11*c* there may be formed such a stepped portion 11*f* as shown in FIG. 7(*b*) on the underside of the flange portion. Further, a thickwall portion 11*g* may be formed on the underside of the flange portion 11*c*, as shown in FIG. 7(*c*).

Figure 8A:
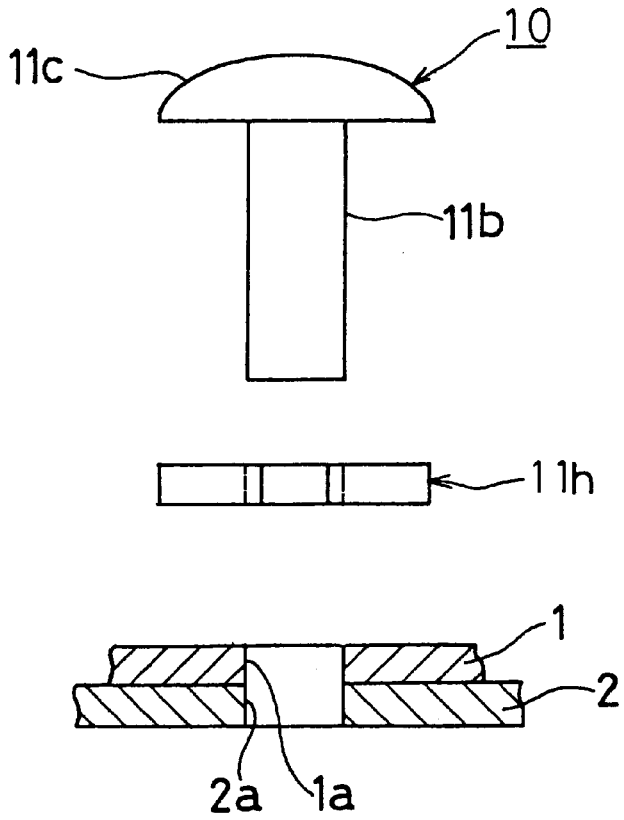
FIG. 8 shows a collar fitted on a blind rivet, in which FIG. 8(*a*) is an explanatory diagram showing a state in which a collar with a slot formed therein is about to be fitted on a body portion of the blind rivet, FIG. 8(*b*) is an explanatory diagram showing a state in which the blind rivet with the collar fitted thereon has been inserted through base metals 1 and 2, and FIG. 8(*c*) is an explanatory diagram showing a state in which the base metals 1 and 2 have been clamped by a plastic deformation of the blind rivet body portion.
Figure 8B:
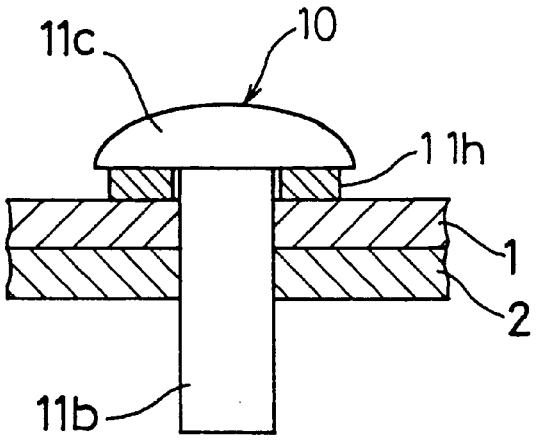
Figure 8C:
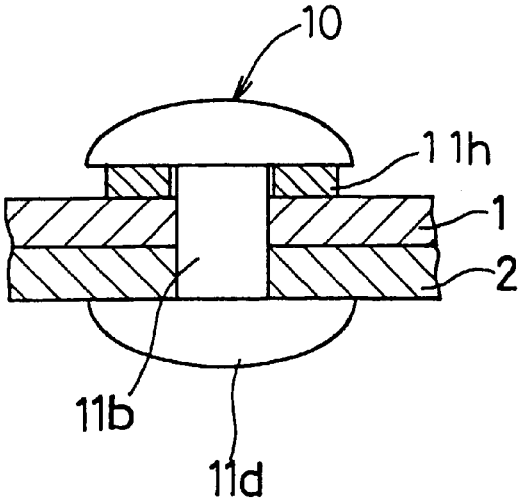

There may be adopted such a construction as shown in FIGS. 8(*a*) to 8(*c*), in which a flat plate-shaped collar 11*h* is fitted on the body portion 11*b* of the blind rivet 10 so as to be interposed between the flange portion 11*c* and the base metal 1, thereby making it easier for the blade edges 111*a* and 121*a* to bite in the boundary portion. The collar 11*h* is broken in disassembling the blind rivet 10.

Figure 9A:
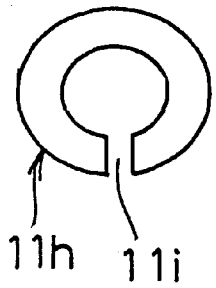
FIG. 9(*a*) is a plan view showing the slotted collar illustrated in FIG. 8, FIG. 9(*b*) is a plan view showing a collar having V grooves, and FIG. 9(*c*) is a plan view showing a collar having through holes.
Figure 9B:
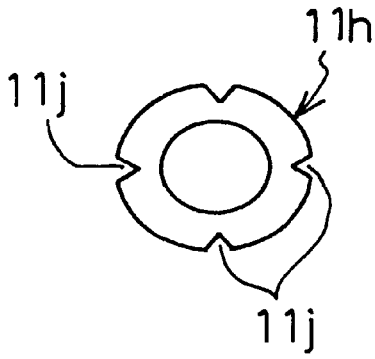
Figure 9C:
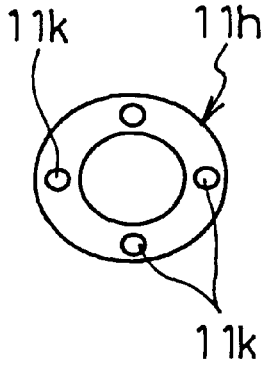

It is optional whether the collar 11*h* be formed with a slot 11*i* as in FIG. 9(*a*), or formed with V grooves 11*j* in circumferential positions of the collar as in FIG. 9(*b*), or formed with through holes 11*k* at equal intervals in the collar as in FIG. 9(*c*). According to the collar 11*h* shown in FIG. 9(*b*), when the collar is pinched by the edges 111*a* and 121*a*, there occurs a stress concentration in the V grooves 11*j*, resulting in the collar 11*h* being broken from near the V grooves 11*j*. The V grooves 11*j* may be formed in the inner periphery of the collar 11*h* instead of forming them in the outer periphery of the collar. Further, the V grooves 11*j* may be. substituted by U grooves. In the case of the collar 11*h* shown in FIG. 9(*c*), the portions where the through holes 11*k* are formed are lower in strength than the other portion, with consequent breakage of the collar from near the portions where the through holes are formed.

Figure 10A:
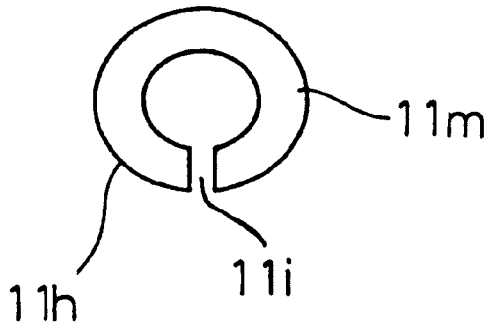
FIG. 10 shows another example of the collar illustrated in FIG. 8, in which FIG. 10(*a*) is a plan view of a slotted collar provided with a binder layer, FIG. 10(*b*) is a side view thereof, and FIG. 10(*c*) is a side view showing a state in which the collar illustrated in FIG. 10(*b*) has been attached to the underside of a flange portion of a blind rivet.
Figure 10B:
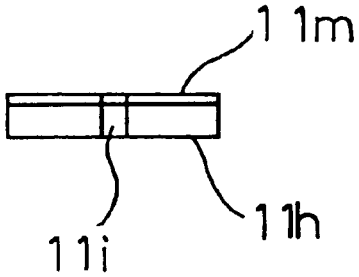
Figure 10C:
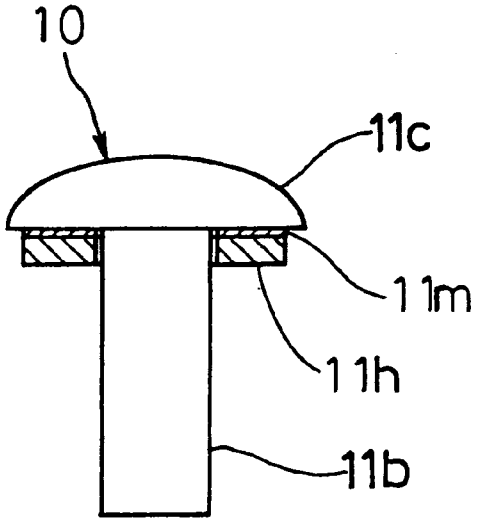

In FIGS. 10(*a*) to 10(*c*), a binder layer 11*m* is formed on an upper end face of the collar 11*h*. The binder layer 11*m* may be formed using a double-coated tape or may be formed using an adhesive. With the binder layer 11*m*, as shown in FIG. 10(*c*), the collar 11*h* can be adhered beforehand to the bottom of the flange portion 11*c* of the blind rivet 10 and therefore it is not necessary that the collar 11*h* be fitted on the body portion 11*b* at every clamping of the blind rivet 10 to the base metals 1 and 2, thus making it possible to shorten the time required for the clamping work and prevent forgetting to fit the collar 11*h* on the body portion.

[Production Line for Disassembling Improperly Driven Rivet]

Now, with reference to FIG. 11, a description will be given below of a process comprising checking a clamped condition of a blind rivet to base metals and, in the case of the clamped condition being found to be unsatisfactory as a result of the checking, cutting and separating the flange portion 11*c*, and the body portion 11*b* from each other, removing the blind rivet from the base metals and recovering the base metals.

S.1 (Rivet Clamping Process)

At least two base metals (works) are clamped with a blind rivet by using a commercially available blind rivet clamping device 13.

S.2 (Clamped Condition Checking Process)

A check is made to see if, for example, a clearance is present between the clamped blind rivet 10 and the works (base metals 1 and 2) (if the works are shaky or not) and if the blind rivet 10 is inclined with respect to the clamping hole surfaces of the works. This clamped condition checking process may be carried out simultaneously with the rivet clamping process (S.1).

S.3 (Rivet Disassembling Process)

If the blind rivet was found to be defective in its clamped condition in the clamped condition checking process (S.2), the blind rivet 10 is removed from-the work by using the blind rivet disassembling device 100A. This rivet disassembling process (S.3) may be carried out simultaneously with the clamped condition checking process (S.2). In the case where the clamped condition checking process (S.2), is carried out simultaneously with the rivet clamping process (S.1), the rivet disassembling process (S.3) may be performed simultaneously with the rivet clamping process (S.1).

S.4 (Work Checking Process)

If the works after disassembly in the rivet disassembling process (S.3) can be utilized again, a shift is made again to the rivet clamping process (S.1) to clamp the two works with a rivet.

On the other hand, if the works after disassembly in the rivet disassembling process (S.3) can no longer be utilized, the works are scrapped.

More particularly, if the clamping holes 1*a* and 2*a* were bent, damaged, or deformed, or if the work themselves were deformed, by the disassembling work in the rivet disassembling process (S.3), the works are scrapped.

S.5 (Unit Assembling Process)

The works judged to be satisfactory in their clamped condition in the clamped condition checking process (S.2) are fed to a unit assembling process on a production line. This unit assembling process comprises, say, n number of steps (n is an integer).

S.6 (Unit Checking Process)

The unit from the unit assembling process is then fed to a unit checking process, which comprises, say, m number of steps (m is an integer) and in which a check is made to see if the assembled condition is good or not and if performance is satisfactory or not. When the unit proved satisfactory in all of the unit checking steps, it is shipped.

The processes in this production line may be carried out manually by workers or may be carried out automatically using a robot which is used in an automation line.

A production line associated with the blind rivet disassembling work for recycling products after recovery of the products may be constituted as follows.

When a product has been recovered from a user, works (base metals 1 and 2) with a blind rivet clamped thereto are disassembled by the disassembling device. When the disassembled works can be utilized again, the works are re-utilized. On the other hand, if the disassembled works cannot be re-utilized, the works are scrapped. If metallic works and resinous works are mixed together, these works should be subjected to a classifying work before their re-utilization, whereby the working efficiency is improved.

[Automatic Rivet Disassembling System for use in Production Line]

Figure 12:
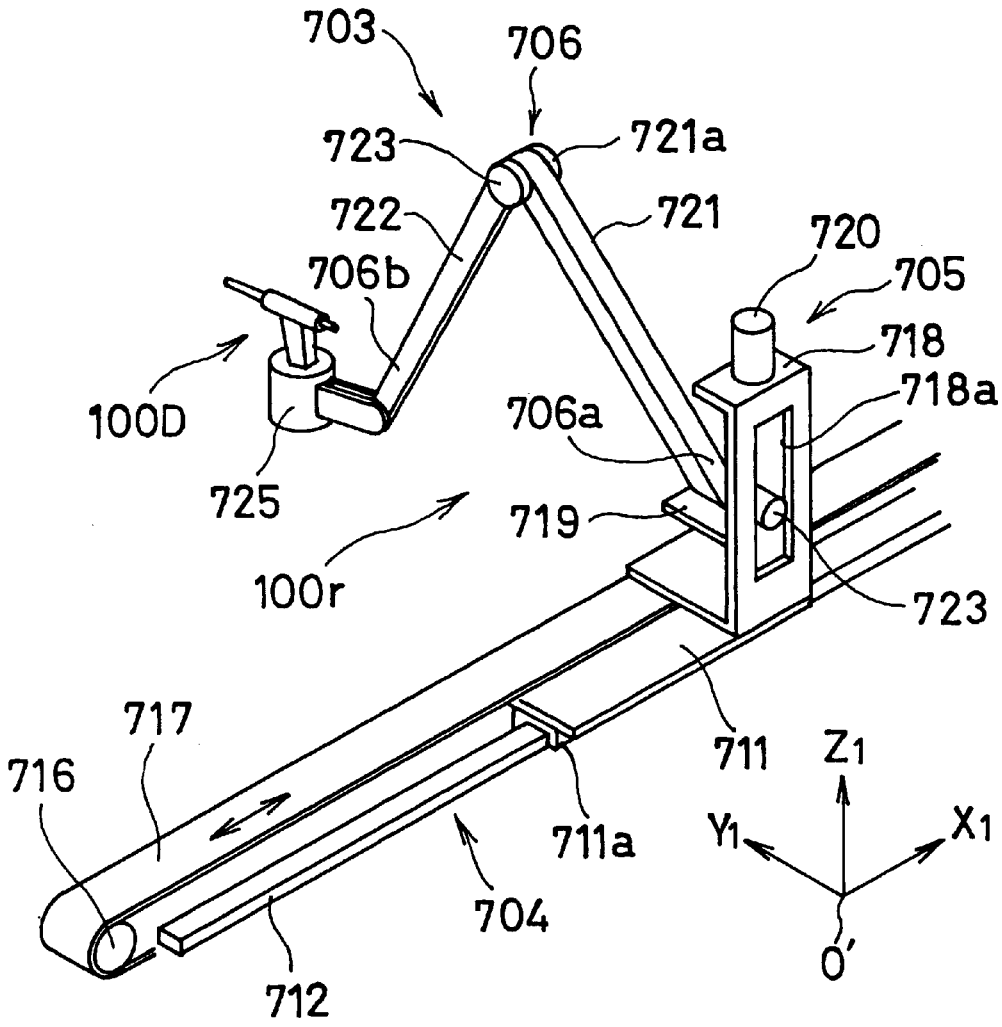
FIG. 12 is a perspective view showing a schematic construction of an automatic blind rivet disassembling system.

As an automatic rivet disassembling system for use in this production line there is used, for example, a system of such a construction as shown in FIG. 12. This automatic rivet disassembling system will be described below.

The numeral 703 denotes a dual arm type robot system. The dual arm type robot system has a pair of arm mechanisms. Each arm mechanism comprises a first arm 704, a second arm 705 and a third arm 706 which are connected together successively. The first arm 704 comprises a base 711 which is moved by a belt drive unit (not shown) and a guide rail 712 which guides the base 711 while being engaged with a guide 711*a* formed in the base 711. The second arm 705 is connected onto the base 711 and is moved in the direction of coordinate axis X1 out of-three predetermined coordinate axes X1, Z1 and Y1 which cross one another at origin O'.

Numeral 716 denotes a driven pulley in the belt drive unit and numeral 717 denotes a belt which is entrained on both a driving pulley (not shown) and the driven pulley 716 and which is fixed at both ends thereof to the base. The driving pulley is driven by a motor and the belt 717 is allowed to travel with rotation of the driving pulley. At the same time, the base 711 causes the second arm 705 to move in the coordinate axis X1 direction with a high accuracy while being guided by the guide rail 712.

The second arm 705 comprises a frame 718 fixed onto the base 711 of the first arm 704, a moving base 719 with a guide rod fitted in a slit 718*a* formed in the frame 718 and to which a base end portion 706*a* of the third arm 706 is fixed, and a motor 720 which causes a screw (not shown) threadedly engaged with the moving base 719 to rotate and thereby move the moving base 719. With rotation of the motor 720 the second arm 705 causes the third arm 706 to move in the coordinate axis Z1 direction together with the moving base 719.

A male screw of the moving base 719 threadedly engaged with the screw which is rotated by the motor 720 is constituted by a ball screw containing a large number of balls so that the moving base 719 moves with smoothness and high accuracy. The guide rod is provided for preventing rotation of the moving base 719. The third arm 706 comprises a first arm member 721 having a base end portion 706*a* at one end thereof, the base end portion 706*a* being fixed to the moving base 719 of the second arm 705 and thereby connected to the second arm, a second arm member 722 having a front end portion 706*b* as one end opposite to the base end portion 706*a*, and a joint portion 723 which connects the opposite end of the second arm member 722 to the opposite end of the first arm member 721 and which causes the second arm member 722 to turn relative to the first arm member 721. The third arm 706 causes the front end portion 706*b* to move in the coordinate axis Y1 direction out of the three predetermined coordinate axes X1, Z1 and Y1 through the joint portion 723. The front end portion 706*b* of the third arm 706 is provided with a hand portion 725 for grasping a blind rivet disassembling device 100D.

Figure 13:
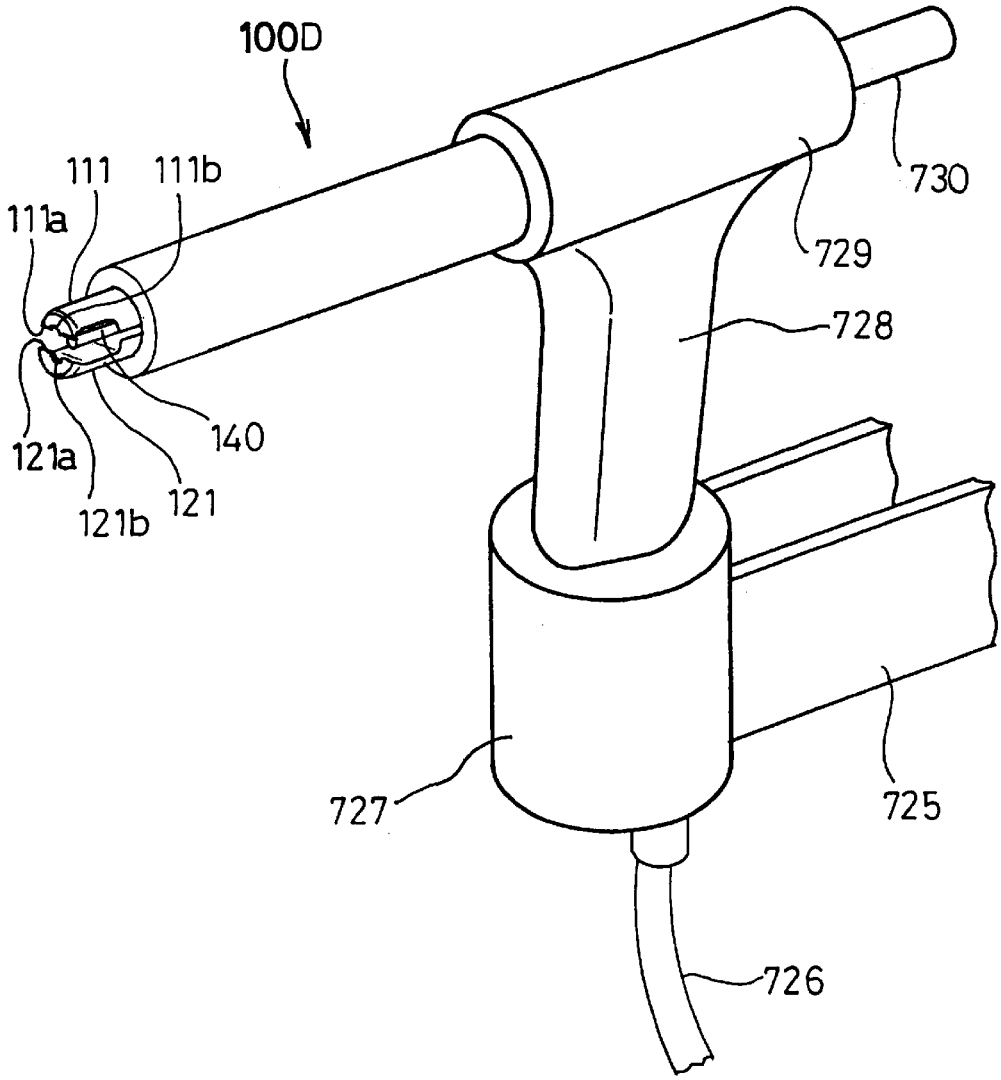
FIG. 13 is a partially enlarged perspective view of a blind rivet disassembling device attached to a front end of an arm used in the automatic blind rivet disassembling system.

As shown on a larger scale in FIG. 13, the blind rivet disassembling device 100D comprises an air hose 726, an air valve 727, a mounting portion 728, an air cylinder 729, and an adjusting knob 730. At a front end of the air cylinder 729 are provided blades 111 and 121 and a push-out pin 140. By means of a piston cylinder drive mechanism the blades 111 and 121 are actuated in approaching and leaving directions of their edges. The piston cylinder drive mechanism can be constituted by improving the blind rivet clamping device 13.

Figure 11:
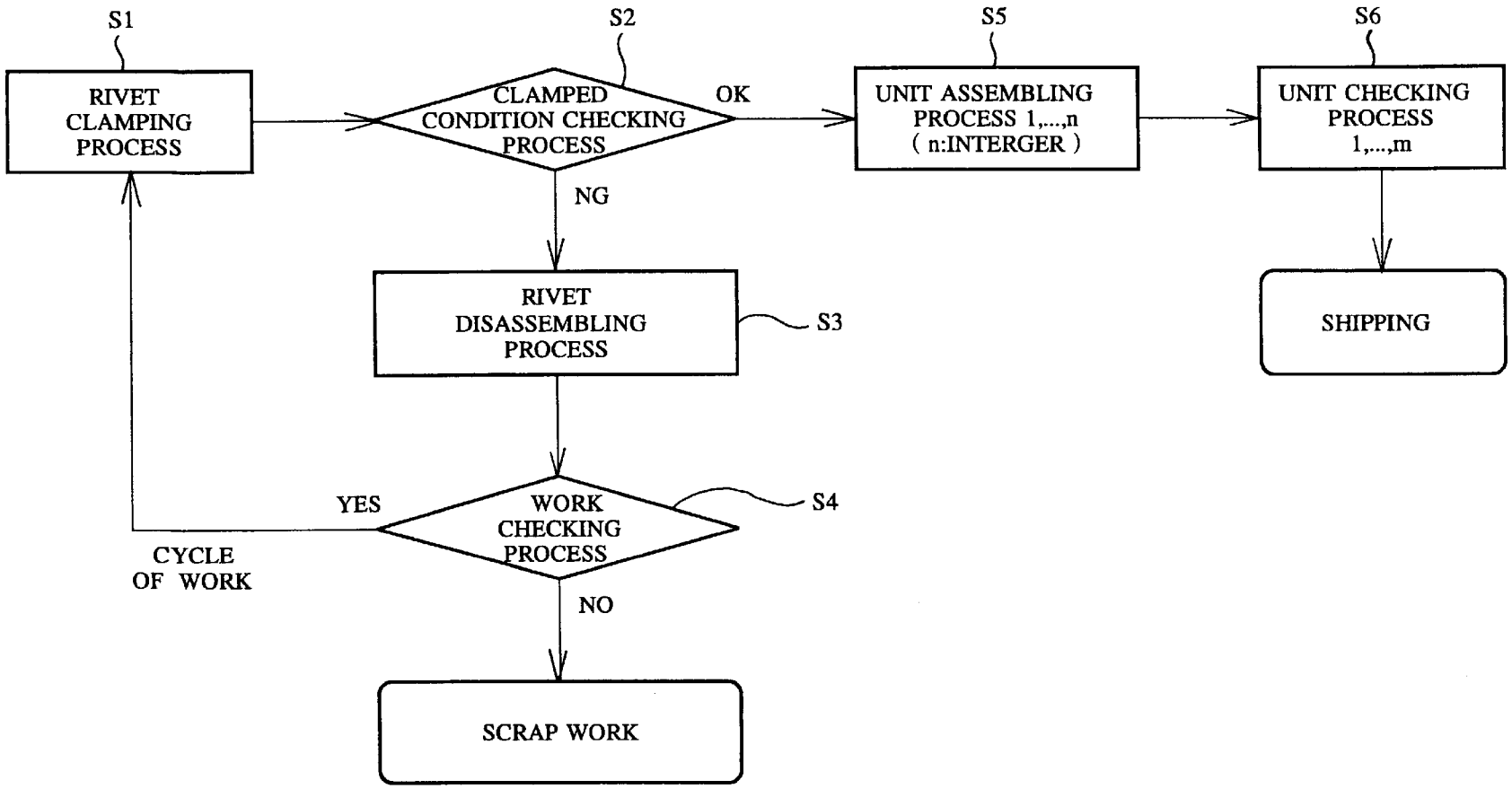
FIG. 11 is a flow chart for explaining a production system involving removal of a blind rivet from a base metal and subsequent recovery of the base metal.

The dual arm type robot system 703 is controlled automatically by a computer, whereby in the event the base metals 1 and 2 should be found defective in their clamped condition in the production line, the blind rivet is disassembled automatically in accordance with the flow chart of FIG. 11.

In cutting the blind rivet, the push-out pin 140 is admitted into the through hole 11*a* interlockedly with the blades 111 and 121.

According to the blind rivet disassembling device and method of the present invention, since the body portion of the blind rivet is cut in a state in which the portion (constriction) to be broken of the residual mandrel remaining in the blind rivet body has been moved to a position not interfering with the cutting work, the blade edges are prevented from striking against the residual mandrel in the cutting work, so that not only the blind rivet body portion can be cut easily by a single operation even without using a large cutting force, but also the blade edges are prevented from being damaged because it is not required to cut the blind rivet forcibly with an excessive force.

The production system according to the present invention facilitates the recovery of base metals.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A blind rivet disassembling device wherein a blind rivet body having a body portion and a flange portion, with a through hole being formed through said blind rivet body in an axial direction of said body portion from the body portion toward said flange portion, is inserted into clamping holes formed in base metals, a mandrel having a stem portion and a head portion, said head portion being substantially integral with said stem portion and larger than the diameter of said through hole of said blind rivet body, is inserted into said through hole, said head portion is pulled into the through hole as said mandrel is pulled, so that a peripheral wall of said body portion around said through hole undergoes a plastic deformation and is bulged and said mandrel is broken, allowing a portion of the mandrel to remain as a residual mandrel within the through hole, said base metals are sandwiched by said bulge of the peripheral wall of said body portion and the head portion of the mandrel, and the blind rivet clamped to the base metals is separated from the base metals, said blind rivet disassembling device comprising:

a cutting means adapted to get in between said flange portion and said base metals and cut said body portion in a direction perpendicular to said axial direction of the body portion toward a center of said through hole;

a push-out means for pushing out said residual mandrel from said flange portion toward said bulge along the axial direction of said body portion;

a moving means for moving said cutting means toward the center of said through hole; and an advancing means which causes said push-out means to advance into said through hole for pushing out said residual mandrel in interlock with the movement of said cutting means.

2. A blind rivet disassembling device according to claim 1, wherein a cutout portion which permits advance and retreat of said push-out means is formed in an edge portion of said cutting means.

3. A blind rivet disassembling device according to claim 1, wherein, after the cutting of said body portion, said advancing means causes said push-out means to be retracted from said through hole in interlock with the movement of said cutting means in a direction away from the center of the through hole.

4. A blind rivet disassembling device according to claim 1, further including a flange portion removing means for removing from said push-out means said flange portion which remains on the push-out means after separation from said body portion.

5. A blind rivet disassembling device wherein a blind rivet body having a body portion and a flange portion, with a through hole being formed through said blind rivet body in an axial direction of said body portion from the body portion toward said flange portion, is inserted into clamping holes formed in base metals, a mandrel having a stem portion and a head portion, said head portion being substantially integral with said stem portion and larger than the diameter of said through hole of said blind rivet body, is inserted into said through hole, said head portion is pulled into the through hole as said mandrel is pulled, so that a peripheral wall of said body portion around said through hole undergoes a plastic deformation and is bulged and said mandrel is broken, allowing a portion of the mandrel to remain as a residual mandrel within the through hole, said base metals are sandwiched by said bulge of the peripheral wall of said body portion and the head portion of the mandrel, and the blind rivet clamped to the base metals is separated from the base metals, said blind rivet disassembling device comprising:

a cutting means having at least a first blade and a second blade both disposed in an opposed relation to each other with said body portion therebetween, said first and second blades being each formed with a semicircular cutout portion nearly centrally;

a moving means which causes said first and second blades to move toward a center of said through hole so that said body portion is cut and separated from said flange portion by said cutting means;

a push-out means adapted to get into said through hole and to push out said mandrel from said flange portion toward said bulge along the through hole, said push-out means having an outside diameter smaller than the diameter of said through hole and also smaller than the diameter of an aperture formed by said semicircular cutout portions of said first and second blades; and an interlocking means which, in interlock with the cutting motion of said cutting means, causes said push-out means to get into said through hole until said mandrel is moved from said blind rivet body.

6. A blind rivet disassembling device according to claim 5, wherein said push-out means is retracted from said through hole in interlock with a retreating motion of said cutting means.

7. A blind rivet disassembling device according to claim 5, further including a flange portion removing means for removing said flange portion from said push-out means, said flange portion having been separated from said body portion and with the push-out means being present therewithin, and an interlocking means which causes said flange portion removing means to move in the axial direction of said body portion in interlock with a retreating motion of said cutting means by said moving means.

8. A blind rivet disassembling device wherein a blind rivet body having a body portion and a flange portion, with a through hole being formed through said blind rivet body in an axial direction of said body portion from the body portion toward said flange portion, is inserted into clamping holes formed in base metals, a mandrel having a stem portion and a head portion, said head portion being substantially integral with said stem portion and larger than the diameter of said through hole of said blind rivet body, is inserted into said through hole, said head portion is pulled into the through hole as said mandrel is pulled, so that a peripheral wall of said body portion around said through hole undergoes a plastic deformation and is bulged and the mandrel is broken, allowing a portion of the mandrel to remain as a residual mandrel within the through hole, said base metals are sandwiched by said bulge of the peripheral wall of said body portion and the head portion of the mandrel, and the blind rivet clamped to the base metals is separated from the base metals, said blind rivet disassembling device comprising:

a cutting means provided with a pair of blades, said blades being opposed to each other and capable of coming into engagement with each other;

a blades engaging/disengaging means which causes the paired blades to be engaged with and disengaged from each other in a direction nearly perpendicular to the axial direction of the body portion of the blind rivet body;

a push-out pin inserted into said through hole and adapted to push out said residual mandrel at a position where the paired blades come into substantial contact with the outer peripheral surface of said flange portion; and a push-out pin advancing/retreating means which causes said push-out pin to advance from said flange portion toward said bulge along said through hole in interlock with an advancing motion of the paired blades by said blades engaging/disengaging means and which causes the push-out pin to retreat in interlock with a retreating motion of the paired blades, said cutting means being constituted by a pair of grip arms having a pair of blades formed at one ends thereof and also having grip portions at the opposite ends thereof, the paired grip arms further having crossing portions where the paired grip arms cross each other at a position close to the paired blades, said crossing portions of said paired grip arms being supported pivotably through a pivot shaft, and said blades engaging/disengaging means comprising levers adapted to turn with said crossing portions as fulcrums.

9. A blind rivet disassembling device according to claim 8, wherein said push-out pin advancing/retreating means is constituted by a resilient member which imparts a biasing force to said cutting means, said biasing force acting in a direction to disengage said blades from each other.

10. A blind rivet disassembling device wherein a blind rivet body having a body portion and a flange portion, with a through hole being formed through said blind rivet body in an axial direction of said body portion from the body portion toward said flange portion, is inserted into clamping holes formed in base metals, a mandrel having a stem portion and a head portion, said head portion being substantially integral with said stem portion and larger than the diameter of said through hole of said blind rivet body, is inserted into said through hole, said head portion is pulled into the through hole as said mandrel is pulled, so that a peripheral wall of said body portion around said through hole undergoes a plastic deformation and is bulged and said mandrel is broken, allowing a portion of the mandrel to remain as a residual mandrel within the through hole, said base metals are sandwiched by said bulge of the peripheral wall of said body portion and the head portion of the mandrel and the blind rivet clamped to the base metals is separated from the base metals, said blind rivet disassembling device comprising:

a cutting means provided with a pair of blades, said blades being opposed to each other and capable of coming into engagement with each other;

a blade engaging/disengaging means which causes said paired blades to be engaged with and disengaged from each other in a direction nearly perpendicular to the axial direction of said body portion of said blind rivet body;

a push-out pin inserted into said through hole and adapted to push out said residual mandrel at a position where the paired blades come into substantial contact with the outer peripheral surface of said flange portion; and a push-out pin advancing/retreating means which causes said push-out pin to advance from said flange portion toward said bulge along said through hole in interlock with an advancing motion of the paired blades by said blades engaging/disengaging means and which causes said push-out pin to retreat in interlock with a retreating motion of the paired blades, said push-out pin advancing/retreating means comprising a first slider link mechanism and a second slider link mechanism, said first slider link mechanism having a pair of push-out links which are in a relation of turning pair to said push-out pin and to a pair of grip arms with the push-out pin as a slider, and said second slider link mechanism having a pair of holding links which are in a relation of turning pair to a holding member with the holding member as a slider, said holding member holding said push-out pin slidably and being moved in a direction opposite to the retracted direction of the push-out pin by said paired grip arms.

11. A blind rivet disassembling device according to claim 8, wherein edges of said blades are formed in a shape adapted to bite into a boundary plane between said flange portion and said base metals.

12. A blind rivet disassembling method wherein a blind rivet body having a body portion and a flange portion, with a through hole being formed through said blind rivet body in an axial direction of said body portion from the body portion toward said flange portion, is inserted into clamping holes formed in base metals, a mandrel having a stem portion and a head portion, said head portion being substantially integral with said stem portion and larger than the diameter of said through hole of said blind rivet body, is inserted into said through hole, said head portion is pulled into the through hole as said mandrel is pulled, so that a peripheral wall of said body portion around said through hole undergoes a plastic deformation and is bulged and said mandrel is broken, allowing a portion of the mandrel to remain as a residual mandrel within the through hole, said base metals are sandwiched by said bulge of the peripheral wall of said body portion and the head portion of the mandrel, and the blind rivet clamped to the base metals is separated from the base metals, characterized in that:

while a push-out means is inserted into said through hole to push out said residual mandrel along the through hole, blades are allowed to get in between said flange portion and said base metals and nip and cut said body portion of said blind rivet body in a direction perpendicular to the axial direction of the body portion.

13. A blind rivet disassembling method according to claim 12, wherein after the cutting operation by said blades and with said push-out means still lying within said through hole, the remaining flange portion is removed from the push-out means.

14. A production system method wherein a blind rivet body having a body portion and a flange portion, with a through hole being formed through said blind rivet body in an axial direction of said body portion from the body portion toward said flange portion, is inserted into clamping holes formed in base metals, a mandrel having a stem portion and a head portion, said head portion being substantially integral with said stem portion and larger than the diameter of said through hole of said blind rivet body, is inserted into said through hole, said head portion is pulled into the through hole as said mandrel is pulled, so that a peripheral wall of said body portion around said through hole undergoes a plastic deformation and is bulged and said mandrel is broken, allowing a portion of the mandrel to remain as a residual mandrel within the through hole, said base metals are sandwiched by said bulge of the peripheral wall of said body portion and the head portion of the mandrel, and the blind rivet clamped to the base metals is removed from the base metals, thereby allowing the base metals to be recovered, characterized in that:

the clamped condition of said blind rivet to said base metals is checked and said residual mandrel is pushed out from said through hole, said body portion of said blind rivet body is nipped and cut in a direction perpendicular to the axial direction of the body portion, then the blind rivet is removed from the base metals, and the base metals are recovered.

15. A production system method wherein a blind rivet body having a body portion and a flange portion, with a through hole being formed through said blind rivet body in an axial direction of said body portion from the body portion toward said flange portion, is inserted into clamping holes formed in base metals, a mandrel having a stem portion and a head portion, said head portion being substantially integral with said stem portion and larger than the diameter of said through hole of said blind rivet body, is inserted into said through hole, said head portion is pulled into the through hole as said mandrel is pulled, so that a peripheral wall of said body portion around said through hole undergoes a plastic deformation and is bulged and said mandrel is broken, allowing a portion of the mandrel to remain as a residual mandrel within the through hole, said base metals are sandwiched by said bulge of the peripheral wall of the body portion and the head portion of the mandrel, and the blind rivet clamped to the base metals is removed from the base metals thereby allowing the base metals to be recovered, characterized in that:

said residual mandrel is pushed out from said through hole, said body portion of said blind rivet body is nipped and cut in a direction perpendicular to the axial direction of the body portion, the blind rivet is removed from the base metals, and the base metals are recovered.

16. A blind rivet disassembling device to disable a blind rivet body having a body portion, a flange portion, a through hole formed through said body portion in an axial direction from the body portion toward said flange portion when the blind rivet is inserted into clamping holes, and a mandrel having a stem portion and a head portion, said head portion being substantially integral with said stem portion and larger than a diameter of said through hole of said blind rivet body, said mandrel being inserted into said through hole when said blind rivet is in use, said blind rivet disassembling device comprising:

a pair of grip arms connected together at and pivotable about a pivot shaft, each grip arm including a cutting blade at a first end to grip and cut the body portion of the blind rivet; and a push out pin configured to be inserted into the through hole of the blind rivet as said pair of grip arms are brought together to grip and cut the body portion of the blind rivet.

17. A blind rivet disassembling device according to claim 16, further comprising:

a first pair of link arms configured to link said push out pin to said pair of grip arms and to extend said push out pin toward the first end of said grip arms when said grip arms are brought together and to retract said push out pin away from the first end of said grip arms when said grip arms are separated from one another.

18. A blind rivet disassembling device to disable a blind rivet body having body portion, a flange portion, a through hole formed through said body portion in an axial direction from the body portion toward said flange portion when the blind rivet is inserted into clamping holes, and a mandrel having a stem portion and a head portion, said head portion being substantially integral with said stem portion and larger than diameter of said through hole of said blind rivet body, said mandrel being inserted into said through hole when said blind rivet is in use, said bind rivet disassembling device comprising:

a pair of grip connected together at and pivotable about a pivot shaft, each grip arm including a blade at a first end to grip the body portion of the blind rivet;

a push out pin configured to be inserted into the through hole of the blind rivet as said pair of grip arms are brought ether to grip the body portion of the blind rivet;

a first pair of link arms configured to link said push out pin to said pair of grip arms and to extend said push out pin toward the first end of said grip arms when said grip arms are brought together and to retract said push out pin away from the first and of said grip arms when said grip arms are separated from one another;

a holder configured to hold said push out pin, said holder being positioned between said pair of grip arms; and a second pair of link arms configured to link said holder to said pair of grip arms and to extend said holder toward the first end of said grip arms when said grip arms are separated from one another and to retract said holder away from the first end of said grip arms when said grip arms are brought together.

19. A blind rivet disassembly device to disable a blind rivet body having a body portion, a flange portion, a through hole formed through said body potion in an axial direction from the body portion toward said flange portion when the blind rivet is inserted into clamping holes, and a mandrel having a stem portion and a head portion, said head portion being substantially integral with said stem portion and larger than a diameter of said through hole of said blind rivet body, said mandrel being inserted into said through hole when said blind rivet is in use, said blind rivet disassembling device comprising:

a pair of grip arms connected together at and pivotable about a pivot shaft, each grip arm including a blade at a first end to grip the body portion of the blind rivet;

a push out pin configured to be inserted into the through hole of the blind rivet as said pair of grip arms are brought together to grip the body portion of the blind rivet; and a pair of coil springs configured to link said push out pin to said pair of grip arms and to extend said push out pin toward the first end of the grip arms when said grip arms are brought together and to retract said push out pin away from the first end of the grip arms when said grip arms are separated from one another.

20. A blind rivet according to claim 16, wherein said push out pin includes a tapered front portion.

21. A blind rivet according to claim 17, wherein said push out pin includes a tapered front portion.

22. A blind rivet according to claim 18, wherein said push out pin includes a tapered front portion.

23. A blind rivet according to claim 19, wherein said push out pin includes a tapered front portion.

* * * * *